US007049714B2

(12) United States Patent
Tran

(10) Patent No.: US 7,049,714 B2
(45) Date of Patent: May 23, 2006

(54) METHOD FOR DETERMINING THE CONDITION OF A ROTARY SWITCH

(75) Inventor: Minh Duc Tran, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 295 days.

(21) Appl. No.: 10/439,675

(22) Filed: May 16, 2003

(65) Prior Publication Data

US 2004/0227408 A1 Nov. 18, 2004

(51) Int. Cl.
*H01H 21/00* (2006.01)
*H01H 19/00* (2006.01)
*H01H 1/50* (2006.01)

(52) U.S. Cl. ..... 307/137; 307/134; 200/11 TC; 200/11 R

(58) Field of Classification Search ..... 307/137, 307/134; 200/11 R, 11 TC
See application file for complete search history.

(56) References Cited

U.S. PATENT DOCUMENTS 3,969,721 A * 7/1976 Chadwick et al. ..... 340/815.45
4,166,945 A * 9/1979 Inoyama et al. ..... 235/379
4,345,145 A * 8/1982 Norwood ..... 219/492
4,493,980 A * 1/1985 Payne et al. ..... 219/448.12
4,800,740 A * 1/1989 Huttemann ..... 68/12.12
5,453,586 A * 9/1995 Stottmann ..... 200/5 R
6,079,401 A * 6/2000 Alvord et al. ..... 126/39 G
6,507,967 B1 * 1/2003 Johnson ..... 8/159
6,775,924 B1 * 8/2004 Bruntz et al. ..... 34/543
6,791,288 B1 * 9/2004 Peterson et al. ..... 318/254

* cited by examiner

*Primary Examiner*—Lynn Feild
*Assistant Examiner*—Michael Rutland-Wallis
(74) *Attorney, Agent, or Firm*—Clifton G. Green; Robert O. Rice; John F. Colligan

(57) ABSTRACT

In a combination switch having both rotary and pushbutton momentary switches, a method for determining which switch has been selected by a user. The method also includes distinguishing between the selection of a rotary switch from a pushbutton switch.

20 Claims, 18 Drawing Sheets

METHOD FOR DETERMINING THE CONDITION OF A ROTARY SWITCH

BACKGROUND OF THE INVENTION

1. Field of the Invention

The invention relates to rotary switches. In one aspect, the invention relates to a rotary switch having a plurality of rotary switch positions that mimic a keystroke from a momentary pushbutton keyswitch. In another aspect, the invention relates to a logic control cycle for a rotary switch for ensuring that a change in circuit conditions from the operation of the rotary switch is properly interpreted as a selected keystroke. In yet another aspect, the invention relates to rotary switches that can be used with a switch array.

2. Description of the Related Art

An array of momentary push-button keyswitches is frequently used in consumer appliances, such as dishwashers, to select particular functions, such as a standard wash cycle, a heavy-duty wash cycle, or a rinse cycle. The push-buttons are mechanically biased into an off/open position. Momentarily depressing the keyswitch closes a circuit, permitting the sending of a signal to a controller. The controller interprets the signal to select a function to activate.

The array of momentary push-button keyswitches typically utilizes a matrix of associated "send" and "receive" electrical lead lines or electrodes that intersect and have their ends connected to the controller. The momentary push-button keyswitches are located at the intersection of the send and receive lines. Depressing a selected push-button keyswitch closes the connection for the corresponding intersecting pair of "send" and "receive" lines to permit the transmission of a signal through the temporary circuit. In most configurations, the intersections of the send and receive lead lines do not literally intersect. Instead the leads lines extend to the momentary push-button switch lying at what would be the point of intersection. Depending on the type of circuit, the send and receive lead lines can overlie each other at different layers in the circuit board and the momentary push-button switches connect the send and receive lead lines at the overlapping zone.

To determine which switch has been selected/depressed, the controller polls the matrix by sequentially sending an electrical signal or "pulse" through each selected "send" line. While sending the electrical signal down a selected send line, the controller then sequentially "samples" the "receive" lines for a return signal. If a return signal is detected on a "receive" line, the controller identifies which push-button has been depressed by its location in the matrix based on the corresponding send and receive lines, and thereby activates the particular function associated with the selected push-button. The total time to signal and sample the entire matrix is typically on the order of a few milliseconds, a time interval much shorter than the time taken by a typical consumer to depress a selected function button. Thus, when a consumer depresses a particular function button, the controller will have signaled and sampled the matrix to identify the selected button.

Upon release by the user, the momentary push-button keyswitches return to the off/open position, thereby opening the connection between the "send" and "receive" line. Indeed, the control assembly is typically designed so that the controller is properly actuated by a momentary connection of the "send" and "receive" lines such as occurs with a momentary push-button keyswitch.

The advantage of a switch array is that multiple switches can use the same send/receive lines thereby reducing the lead line requirements as compared to each switch having its own dedicated lead lines. The structure also permits a greater density of switches to be placed on a printed circuit board as compared to each switch having its own dedicated lead lines. However, for the switch array to provide these benefits and advantages, it is important that the switches rest state be in an open position so they do not short the array.

While switch arrays using momentary push-buttons are very useful, they are incompatible with switching devices that remain in the closed position during their rest state. Most notably, the common rotary switch is such a switch that historically has been constructed to remain in the closed position as its steady state. In other words, rotary switches are typically designed for connecting a "send" and "receive" line in order to enable a continuous, rather than momentary, signal to be sent through the switch, thus rendering the rotary switch incompatible with the send and receive line array designed for momentary switches.

The selection between momentary push-buttons and a rotary switch is often a design choice. In some instances, the use of a rotary switch may be a matter of personal preference for a particular user. Some users may find that a rotary switch is intuitively more appropriate for certain switching functions. A rotary switch may be easier to operate for some users.

It is desirable to have rotary switches and momentary push-button arrays that are interchangeable so that either switch could be used. The interchangeability of rotary switches and momentary push-button arrays would provide appliance control designers with greater flexibility. It would also make possible the consumer being able to select their preferred switch.

SUMMARY OF THE INVENTION

The invention relates to a method for determining which switch is selected in a control panel comprising an array of momentary pushbutton switches, each operable between an open condition and a closed condition and a rotary switch having multiple rotary momentary switches, each operable between an open condition and a closed condition. A processor is electrically coupled to all the switches and programmed to determine which of the switches is selected.

The method comprises polling the open/closed condition of the pushbutton and rotary momentary switches, and determining whether the user-selected switch is one of the pushbutton or one of the rotary momentary switches based on the polled open/closed condition.

The polling can be accomplished by electrically testing the open/closed condition of the pushbutton and rotary momentary switches. The polling is repeated for a predetermined time, which is preferably great enough to permit multiple pollings of each of the pushbutton and rotary momentary switches.

The method can further comprise determining when the user-selected switch is one of the rotary momentary switches. If the user-selected switch is one of the rotary momentary switches, the method includes determining if the user-selected switch is indicative of a new selection by the user. The new selection can be determined by comparing a current selection of the user-selected rotary switch to a prior selection of the user-selected rotary momentary switch and determining if the current selection is different from the prior selection.

The method can include the user selecting the rotary switches by rotating a knob. If a knob is rotated to select the switches, the method can further comprise determining if there is a rapid-rotation condition where the user is rotating the knob at a rate faster than what can be read by the controller. The determination of the rapid-rotation condition can include determining if the user-selected rotary switch is made prior to the predetermined time. If the rapid-rotation condition exists, the determination of the user-selected rotary switch can be made after a single strobing of each of the rotary switches by the controller.

The method can also include the determination of a slow-rotation condition where the user is rotating the knob at a rate such that the user does not select the rotary switch within the predetermined time. Under a slow-rotation condition, the user-selected rotary switch is determined after a time out period, which is greater than the predetermined time, and after each of the rotary switches is polled a predetermined number of times. Preferably, each of the rotary switches are polled at least three times.

DESCRIPTION OF THE PREFERRED EMBODIMENT

Figure 1:
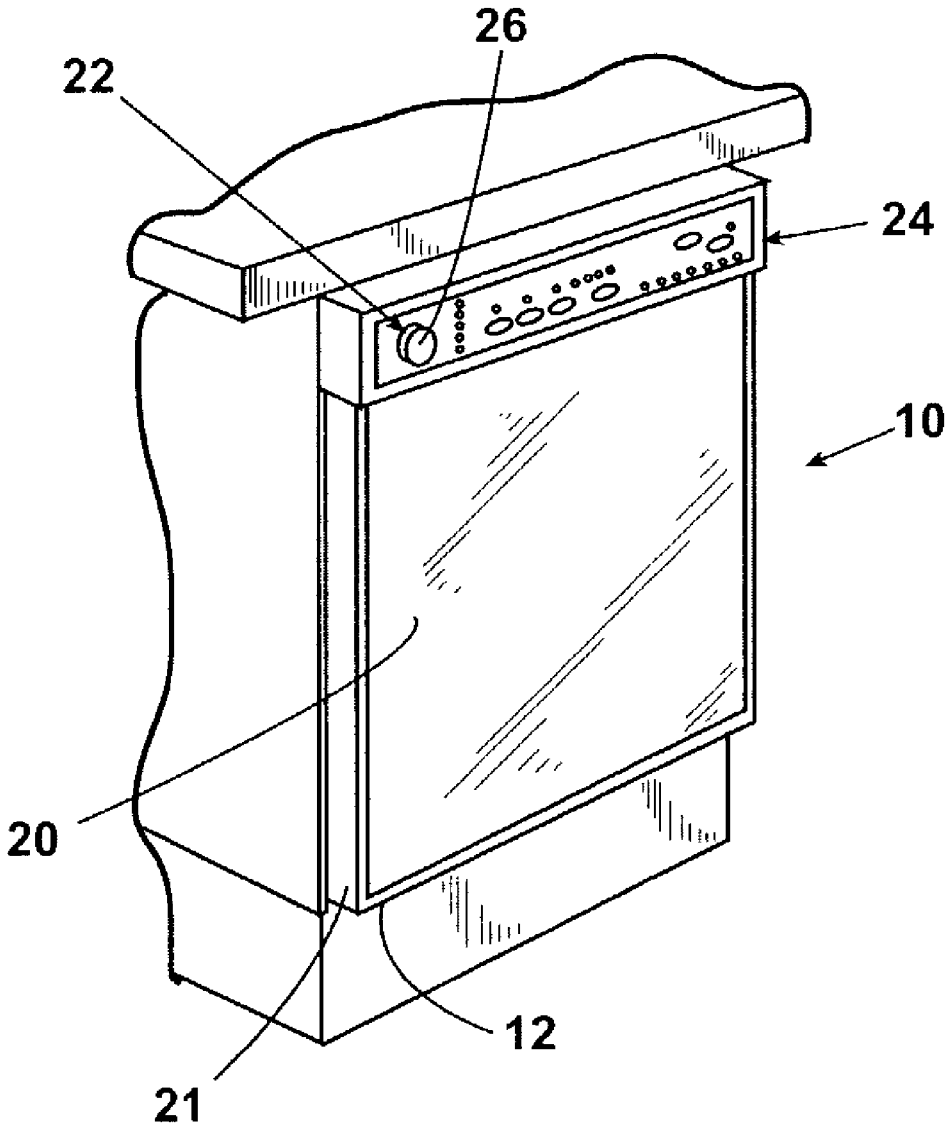
FIG. 1 is a perspective view of a portion of an automatic dishwasher having a control panel with a plurality of momentary pushbutton keyswitches and a rotary switch according to the invention.

Referring to FIG. 1, a dishwasher suitable for incorporating the present invention is shown at 10. As can be readily understood by one skilled in the art, the dishwasher 10 is provided with a door 20, which is hingedly supported to pivot about its bottom edge 12. The door 20 is comprised of a peripheral frame 21, and an exemplary control panel 22 which houses the control mechanism for the dishwasher 10 and supports operator controls 24, including a rotary switch 26 according to the invention for selecting from among several dishwashing cycles.

Figure 2:
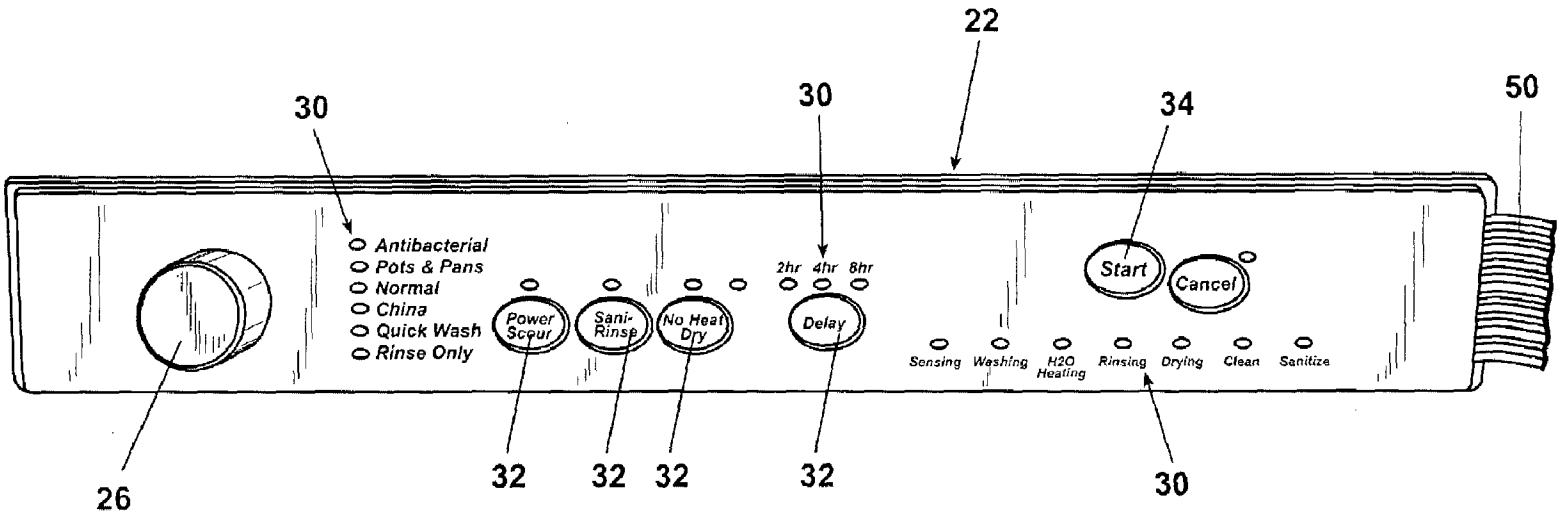
FIG. 2 is a close-up view of the obverse face of the control panel shown in FIG. 1.

FIG. 2 shows a close-up of an obverse face of the control panel 22. The control panel 22 is shown comprising two sets of switches and a plurality of indicator lights 30. The switches comprise a plurality of pushbutton function switches 32, including a start switch 34, and the rotary switch 26. The indicator lights 30 correspond to one of the switches and/or have corresponding indicia to indicate the status of the particular switch.

The rotary switch 26 enables the selection of a wash cycle. The wash cycles shown in FIG. 2 include antibacterial, pots and pans, normal, china, quick wash, and rinse only cycles. While these are the preferred wash cycles, they are merely illustrative of the cycles selectable by the rotary switch 26, and can comprise more, fewer, or other wash cycles than those illustrated. Additionally, the rotary switch 26 can be used for selection of other functions besides wash cycles. The pushbutton switches 28 relate to other functions which complement the wash cycles selected by the rotary switch 26. These are shown illustratively in FIG. 2 as "power scour," "sani-rinse," "no heat dry," and "delay." "Start" and "cancel" switches are also shown illustratively in FIG. 2 as pushbutton switches.

The indicator lights 30 provide a visual reinforcement of the cycle or function selected by the rotary switch 26 or the pushbutton switches 32. These are shown illustratively in FIG. 2 as corresponding to each wash cycle, "power scour," "sani-rinse," "no heat dry," "delay," the start delay time (2, 4, or 8 hours) selected by the "delay" switch, and the current wash cycle stage ("sensing," "washing," "rinsing," etc.).

The lights and switches are interconnected to a computer-based controller 200 (see FIG. 8) through a conventional ribbon connector 50. Preferably, the controller is a programmable micro-controller or micro-processor well-known in the art for controlling the operation of an appliance such as the dishwasher discussed herein.

Figure 3:
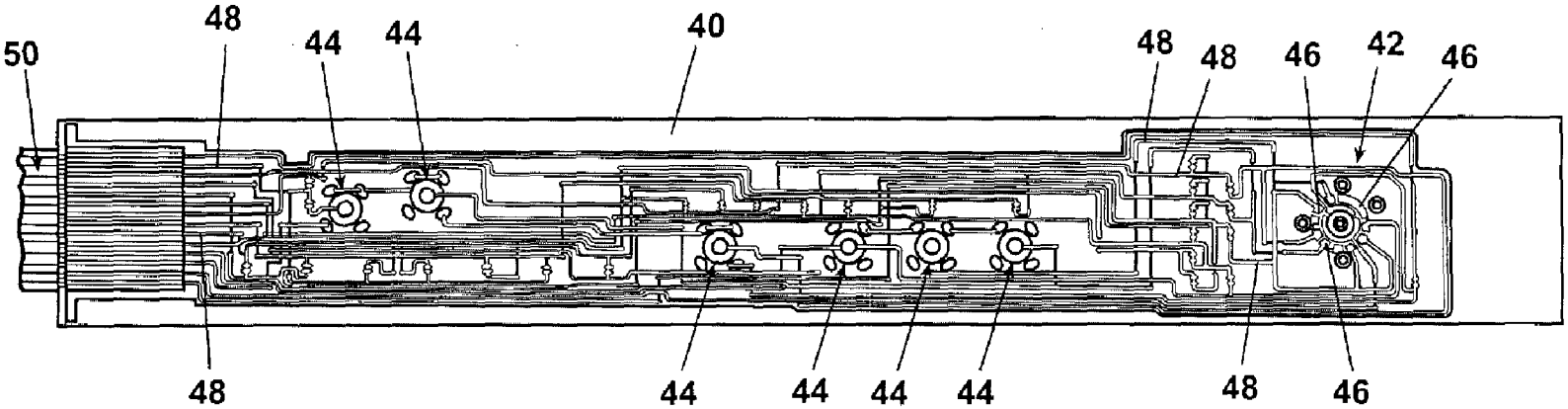
FIG. 3 is a close-up view of the reverse face of the control panel of FIG. 2 showing the electrical interconnection of the momentary pushbutton keyswitches and the rotary switch on a circuit board.

FIG. 3 shows a reverse, interior face of the console panel 22 comprising a circuit board 40. The circuit board 40 is printed in a generally conventional manner with a rotary switch electrode matrix 42, a plurality of pushbutton switch electrode matrices 44, and electrical leads 48 operably connected to the ribbon connector 50. The rotary switch electrode matrix 42 comprises a plurality of circumferentially-distributed electrodes 46, as more fully described hereinafter. The electrodes 46 are operatively separated into a series of inner electrodes 86 and a series of outer electrodes 88 as shown in FIG. 4.

Figure 4:
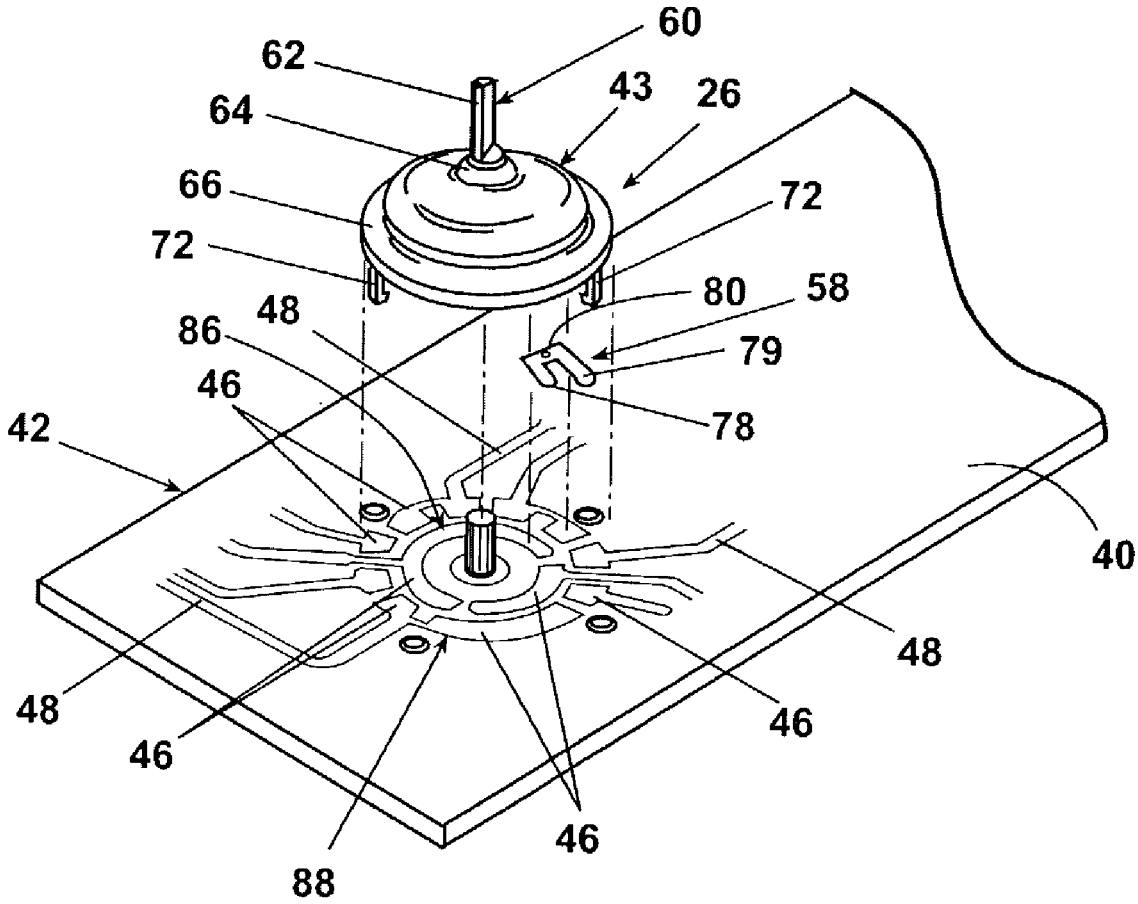
FIG. 4 is an exploded view of the rotary switch shown in FIG. 1 and the associated circuitry printed on the circuit board.

Referring to FIG. 4, the rotary switch 26 comprises a switch mechanism 43 in combination with the matrix 42. The switch mechanism 43 controls the electrical coupling of the inner and outer electrodes 86, 88 to perform the switching function. The switch mechanism is attached to the circuit board 40 for operable communication with the rotary switch electrode matrix 42. The switch mechanism 43 shown in FIG. 4 is attached to the circuit board 40 with a snap-fit attachment which can enable replacement of the switch mechanism 43. However, the switch mechanism 43 can also be attached to the circuit board 40 in a conventional manner providing a permanent attachment, such as an adhesive or welded attachment. When installed to the circuit board 40, the switch mechanism 43 will be operatively aligned over the electrodes 46, as hereinafter described.

Figure 5A:
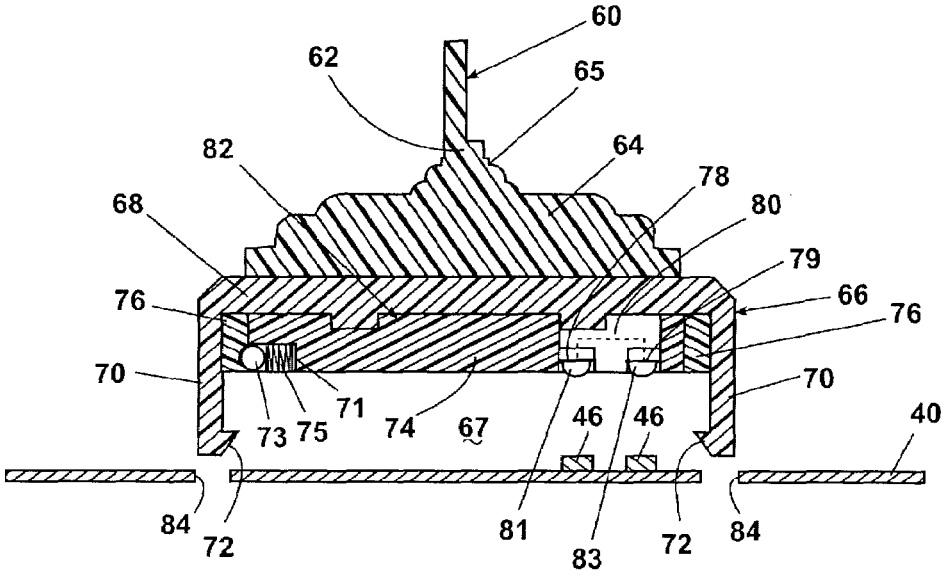
FIG. 5A is a partial cutaway view of an embodiment of the rotary switch shown in FIG. 1.

FIG. 5A shows a partial sectional view of an exemplary embodiment of the rotary switch 26. The switch mechanism 43 comprises a rotor assembly 82 comprising a rotor 60 having a generally cylindrical shaft 62 fixedly attached to a generally plate-like, circular head 74. The shaft 62 is adapted for attachment of a knob (shown in FIGS. 1 and 2). Rotation of the shaft 62 will urge the rotation of the head 74.

A housing 66 comprises a generally circular, plate-like top wall 68 which terminates in an annular sidewall 70 depending therefrom to define a receptacle 67. Extending axially upwardly from the top wall is a collar 64 comprising an annular body having an axial bore 65 therethrough adapted for slidable insertion of the shaft 62 coaxially therewith. The top wall 68 is rigidly attached to the collar 64 coaxially therewith, and is provided with an aperture (not shown) therethrough, which is coaxial with the bore 65, and adapted for slidable insertion of the shaft 62 coaxially therewith. An annular inner ring 76 is adapted to be slidably received within the receptacle 67 to provide an interference fit with the sidewall 70 to prevent circumferential movement of the inner ring 76 relative to the sidewall 70. Alternatively, the inner ring 76 and the sidewall 70 can be provided with mating structures, such as bosses and recesses, to lock the inner ring 76 to the sidewall 70 to prevent their relative circumferential movement. The inner ring 76 is adapted for slidable communication with the circular head 74. As the shaft 62 is rotated, the head 74 will rotate within the inner ring 76.

Figure 5B:
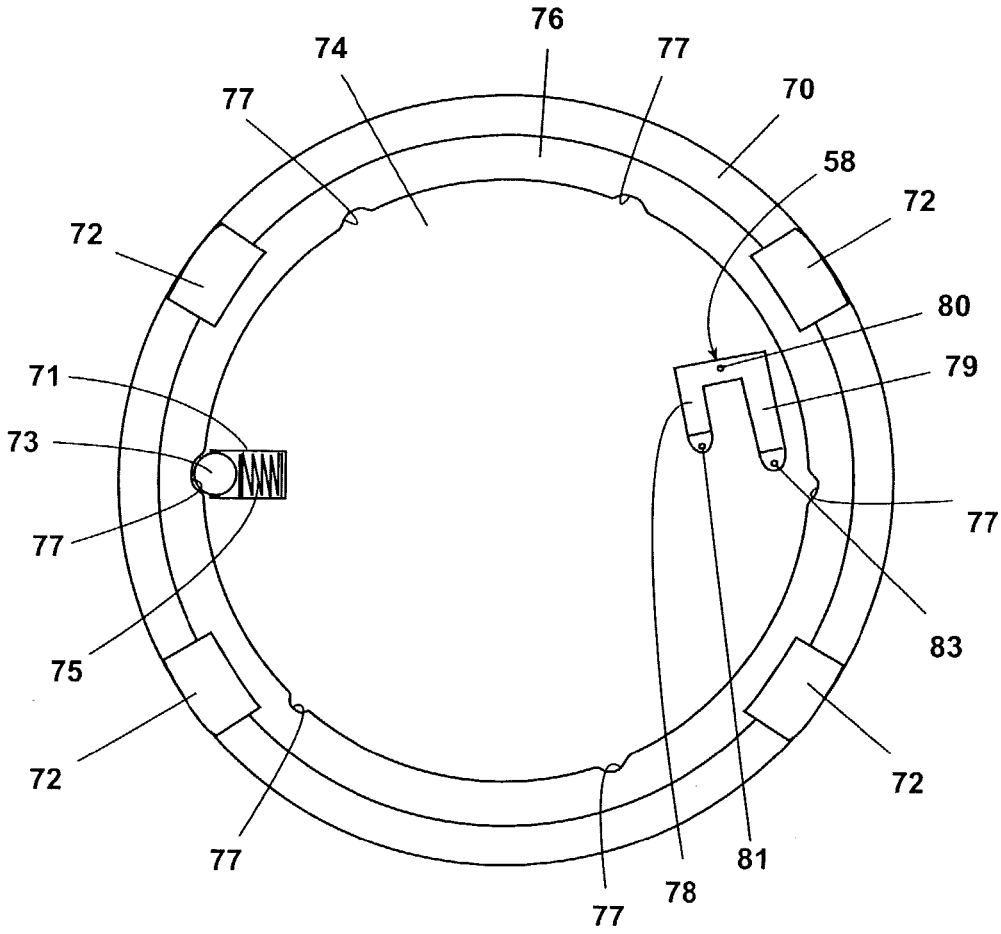
FIG. 5B is a bottom plan view of the embodiment of the rotary switch shown in FIG. 5A.

As shown in FIG. 5B, the inner ring 76 is provided with a plurality of regularly circumferentially spaced-apart detents 77, preferably corresponding in number to the number of wash cycles to be selected with the rotary switch 26. Referring also to FIG. 5A, the circular head 74 is provided with an elongated, radially-oriented, preferably rectilinear or cylindrical chamber 71 for receipt of a ball 73 and spring 75 therein. The chamber 71, the ball 73, and the spring 75 are adapted so that the ball 73 is urged radially outwardly of the circular head 74 by the spring 75 to communicate with the detents 77 as the circular head 74 rotates within the inner ring 76.

The sidewall 70 is shown in FIGS. 4, 5A, and 5B as terminating in a plurality of circumferentially-spaced, radially inwardly-extending hooks 72. The hooks 72 are adapted for snap-fit communication with mating openings 84 in the circuit board 40 for operably securing the rotary switch 26 to the circuit board 40. Alternatively, the rotary switch 26 can be adapted for mounting to the circuit board 40 through an adhesive or welded attachment.

As shown conceptually in FIG. 5B, the head 74 is provided with a conductor 58 comprising a pair of parallel, radially-offset contact arms 78, 79 adapted for operable communication with the rotary switch electrode matrix 42. An inner contact arm 78 has a contact surface 81 for electrically contacting an inner electrode 86 on the circuit board 40, and an outer contact arm 79 has a contact surface 83 for electrically contacting an outer electrode 88 on the circuit board 40. The inner contact arm 78 is connected to the outer contact arm 79 through a conductor strap 80 for conducting electricity from the contact surface 81 to the contact surface 83. The conductor 58 is fixedly attached to the head 74, as shown in FIG. 5B. The contact arms 78, 79 are adapted so that, when the rotary switch 26 is installed to the circuit board 40, the contact arms 78, 79 will be operatively aligned with the electrodes 86, 88 comprising the rotary switch electrode matrix 42, as shown also in FIG. 4 and hereinafter described. As the rotary switch 26 is rotated, the inner contact arm 78 will slide along the inner electrode 86, and the outer contact arm 79 will slide along the outer electrode 88. It will be appreciated by one of ordinary skill in the art that the electrical connection between the electrodes 86, 88 can be provided by other assemblies capable of slidable electrical contact with the electrodes 86, 88 as the rotary switch 26 is rotated.

Figure 6:
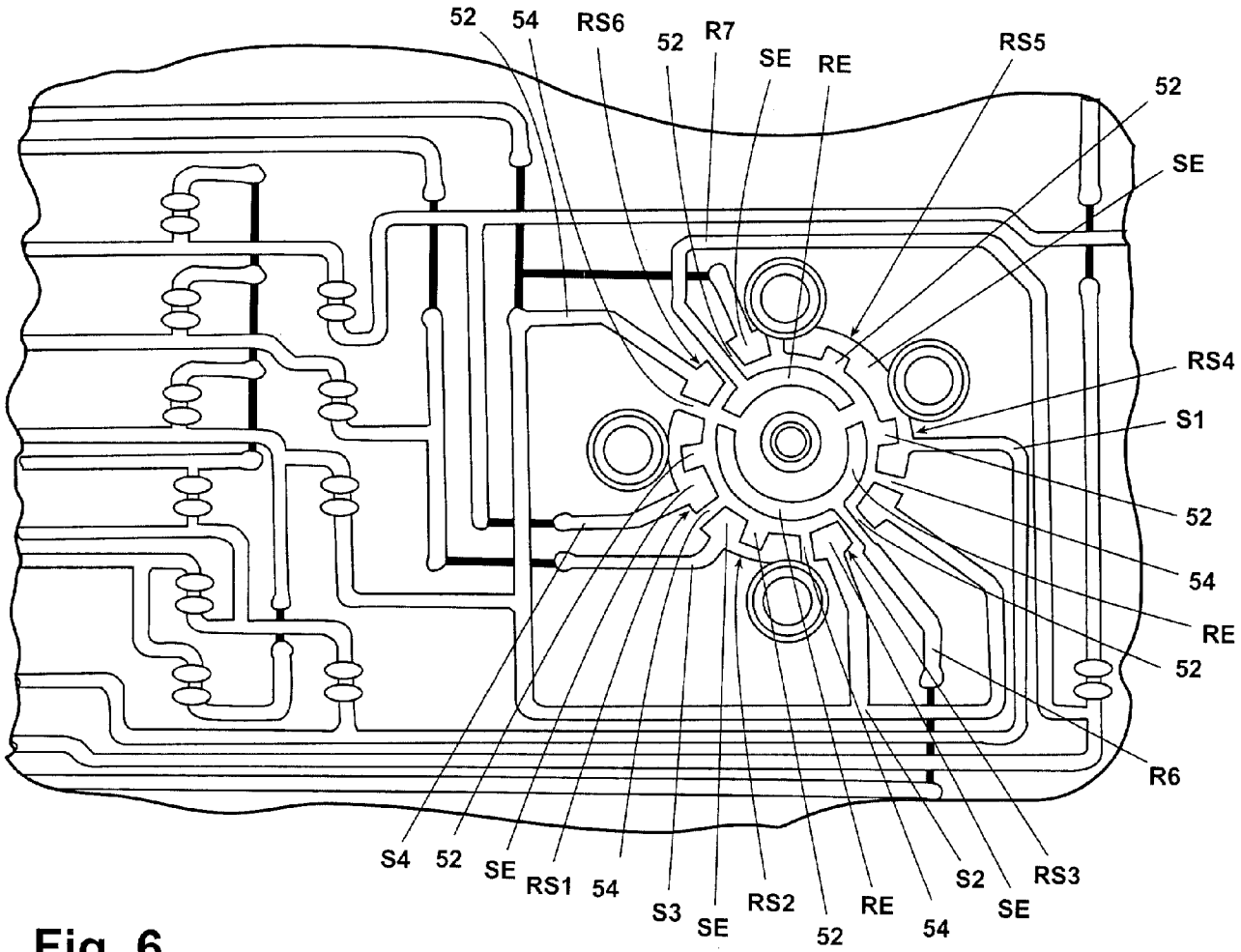
FIG. 6 is a close-up view of the circuit board shown in FIG. 5 showing the portion of the circuit board for the rotary switch.
Figure 8:
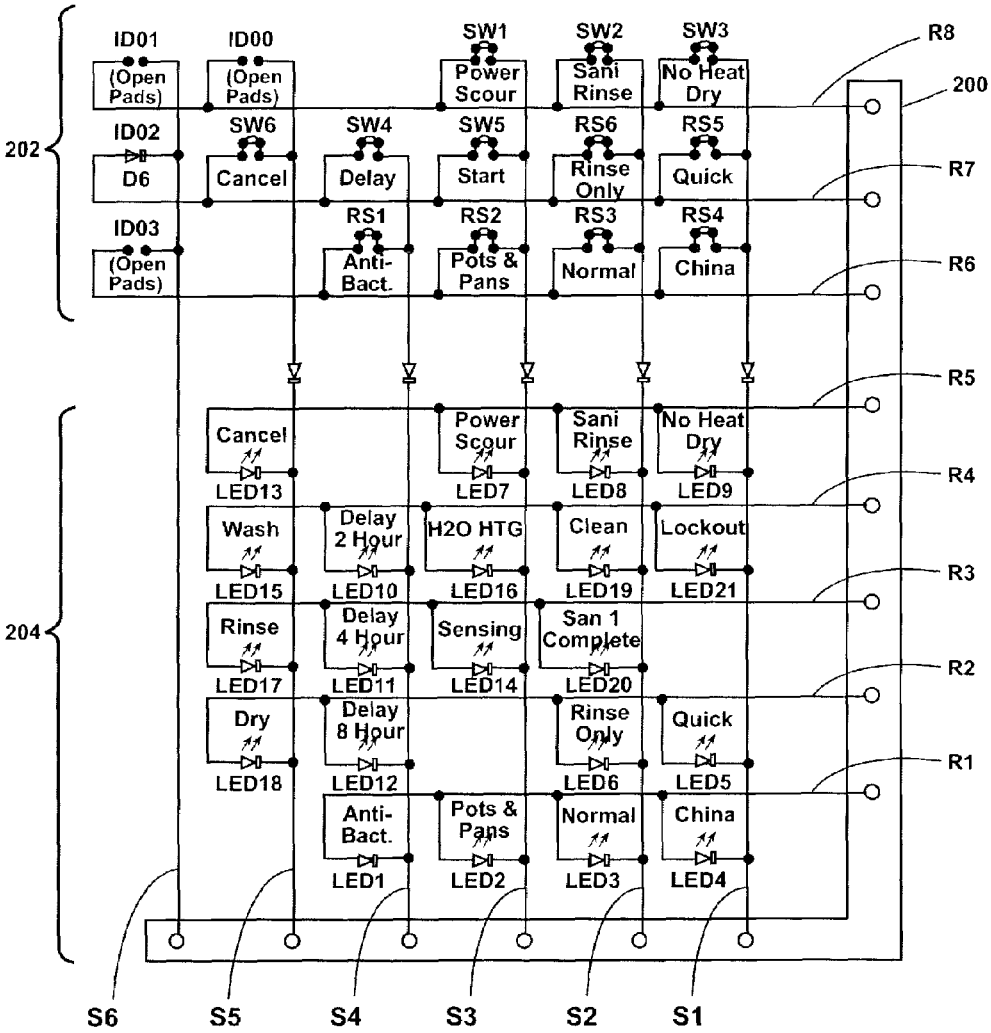
FIG. 8 is a schematic of an array of momentary pushbutton keyswitches and the rotary switch of FIG. 1 connected to a computer-based controller for controlling the wash cycles and complementary functions of the dishwasher.

FIG. 6 illustrates the rotary switch electrode matrix 42 as it appears on the printed circuit board 40 and comprises a plurality of rotary switches RS1–RS6, each of which corresponds to a wash cycle. Each rotary switch comprises an outer send electrode SE (corresponding to the outer electrode 88 shown in FIG. 4, which can be shared among a plurality of switches) and an inner receive electrode RE (corresponding to the inner electrode 86 shown in FIG. 4, which can be shared among a plurality of switches), which are connected to a microprocessor 200 (shown schematically in FIG. 8) by a corresponding send lead S1–S4 and a receive lead R6–R7, respectively. (FIG. 8 shows the send/receive line structure in detail.) The conductors and leads are imprinted onto the circuit board 40 in a manner well-known in the art.

The send and receive electrodes can be swapped. That is, the signal could be sent along what is currently called the receive electrode and received along what is currently called the send electrode.

The receive electrodes RE have a generally arcuate shape and are arranged in a generally circular pattern having a first diameter. Similarly, the send electrodes SE have a generally arcuate shape and are arranged in a generally circular pattern having a second diameter, which as illustrated is greater than the first diameter, such that there is an electrically non-conductive space between the receive electrodes RE and the send electrodes SE. The conductor 58 spans the separation between the receive electrodes RE and send electrodes SE to close the corresponding rotary switch RS1–RS6 and place the corresponding circuit in an ON state, otherwise the rotary switches RS1–RS6 are always open and in an OFF state.

The send electrodes SE have an intra-electrode space 52, which can extend partially or entirely through the receive electrode RE. Rotary switches RS1, RS2, RS4, and RS5 show the intra-electrode space 52 extending partially through their corresponding send electrode SE. Rotary switches RS3 and RS6 show the intra-electrode space 52 extending entirely through the send electrode SE. Each intra-electrode space 52 corresponds with the detent position 77 (shown in FIG. 5B) for the corresponding rotary switch RS1–RS6. The intra-electrode space functions to provide a physical location within the send electrode SE where the conductor 58 will not establish an electrical connection between the send electrode and receive electrode. Since the intra-electrode space is preferably located at a detent position 77, there is preferably no electrical conduction through the switches RS1–RS6 when the switch is in a detent position 77.

Adjacent send electrodes SE are, for the most part, separated by an inter-electrode space 54 to electrically separate adjacent switches. No such electrical separation is required for the send electrodes of rotary switches RS4 and RS5 since they use a separate receive line S6 and S7 for connecting to the processor and are thereby electrically isolated through the separate receive lines.

The intra-electrode spaces 52 and the inter-electrode spaces 54 correspond to non-electrically conductive portions of the circuit board 40. Alternatively, the electrodes 46 can be provided with a non-conductive material or coating corresponding to the intra-electrode spaces 52 and the inter-electrode spaces 54 to separate the electrodes 46 into the paired electrically conductive contacts and intervening non-conductive portions. The inter-electrode spaces 54 are minimized to thereby maximize the area of the contact.

The circular arrangement of both the receive RE and send SE electrodes is centered about the axis of rotation of the shaft 62. The non-conductive space corresponds to the radial separation between the contact arms 78, 79. Thus, when the knob is mounted to the circuit board, the contact surface 83 of the contact arm 79 overlies the send electrodes SE and the contact surface 81 of the contact arm 78 overlies the receive electrodes RE. The contact surfaces 81, 83 thus traverse the receive electrodes RE and the send electrodes SE when the shaft is rotated to close the circuit between the send and receive electrodes and establish an ON condition for the circuit. When the knob is rotated to a detent position, the contact surfaces 81, 83 will overlie the intra-electrode space 52, which stops current flow through the switch to place the switch in an open and OFF condition. To maximize the time that the circuit is closed and ON, the intra-electrode space 52 and the inter-electrode space 54 are minimized.

The operation of the rotary switch 26, with the resulting opening and closing of the corresponding electrical circuits, will now be described with reference to FIGS. 7A–7E. The following description will reflect, as an example, moving the rotary switch 26 from position RS2 to position RS1.

Figure 7A:
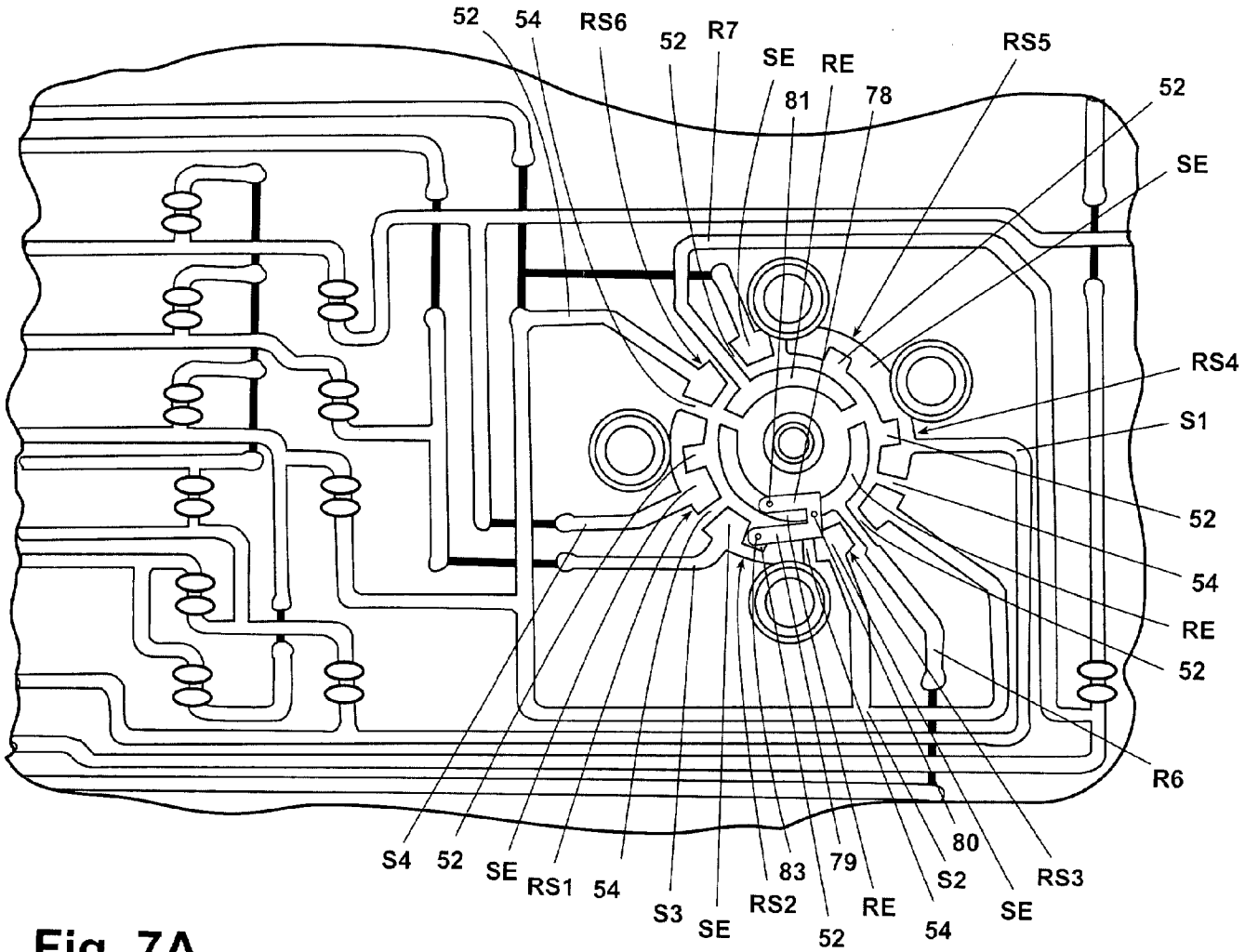
FIG. 7A is a close-up view of the circuitry shown in FIG. 6 illustrating the rotary switch in a first operable position.

In FIG. 7A, the rotary switch 26 is shown positioned so that the inner contact arm 78 is in electrical contact with the receive electrode RE corresponding to position RS2. The outer contact arm 79 rests at the first send electrode SE in an intra-electrode space 52 corresponding to position RS2. Thus, no current flows between the receive electrode RE and the send electrode SE, and switch RS2 is in an OFF condition. As described previously, the intra-electrode space 52 preferably corresponds to a detent 77 in the inner ring 76 to provide a positive stop at the intra-electrode space 52.

Figure 7B:
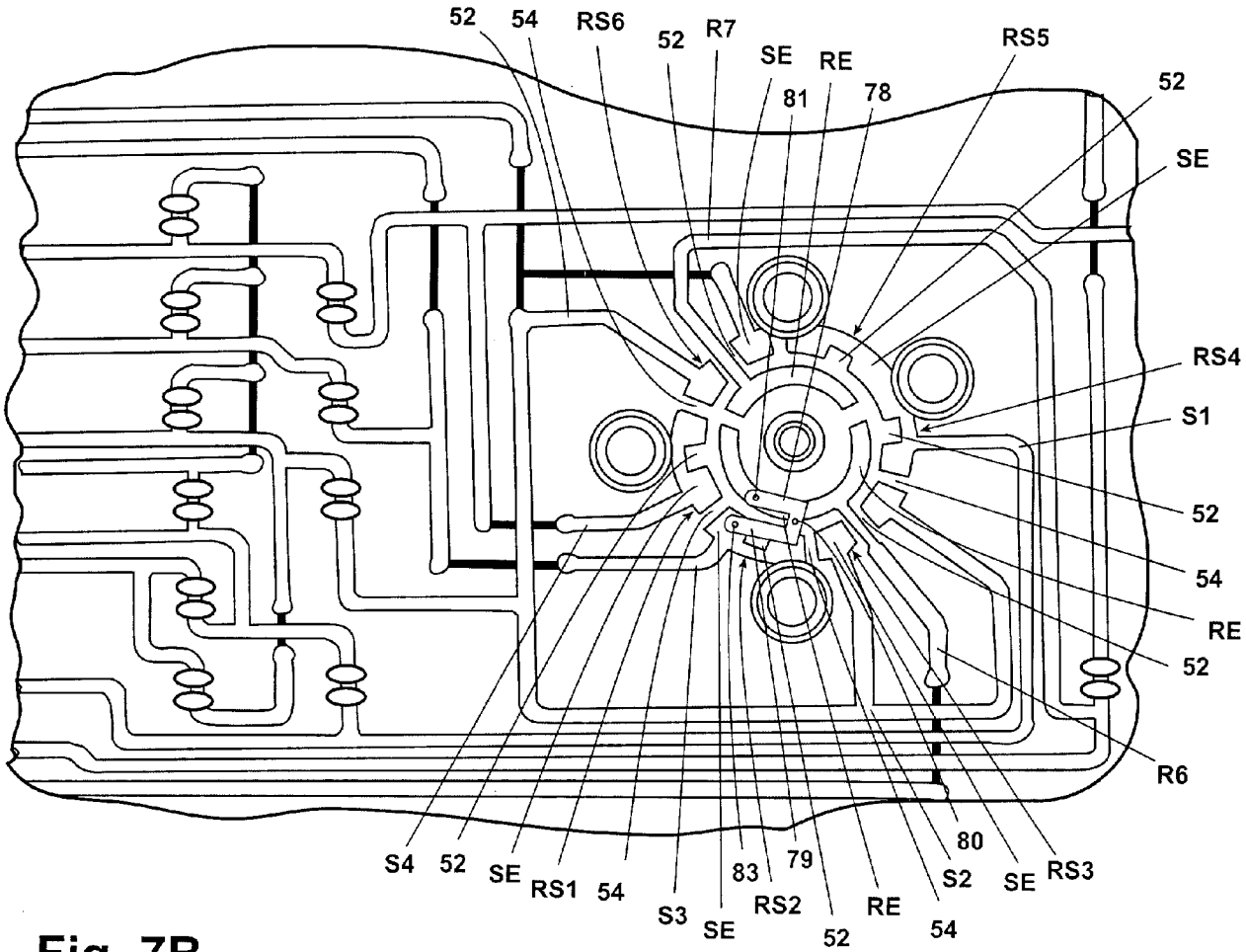
FIG. 7B is a close-up view of the circuitry shown in FIG. 6 illustrating the rotary switch in a second operable position.

FIG. 7B shows the position of the rotary switch 26 as it is rotated clockwise so that the outer contact arm 79 is in electrical contact with the send electrode SE corresponding to position RS2, and the inner contact arm 78 is in electrical contact with the receive electrode RE corresponding to position RS2. Thus, current can flow from the send lead S3, through the receive electrode RE, through the outer contact arm 79, the conductor strap 80, and the inner contact arm 78, through the receive electrode RE, to the receive lead R6.

Figure 7C:
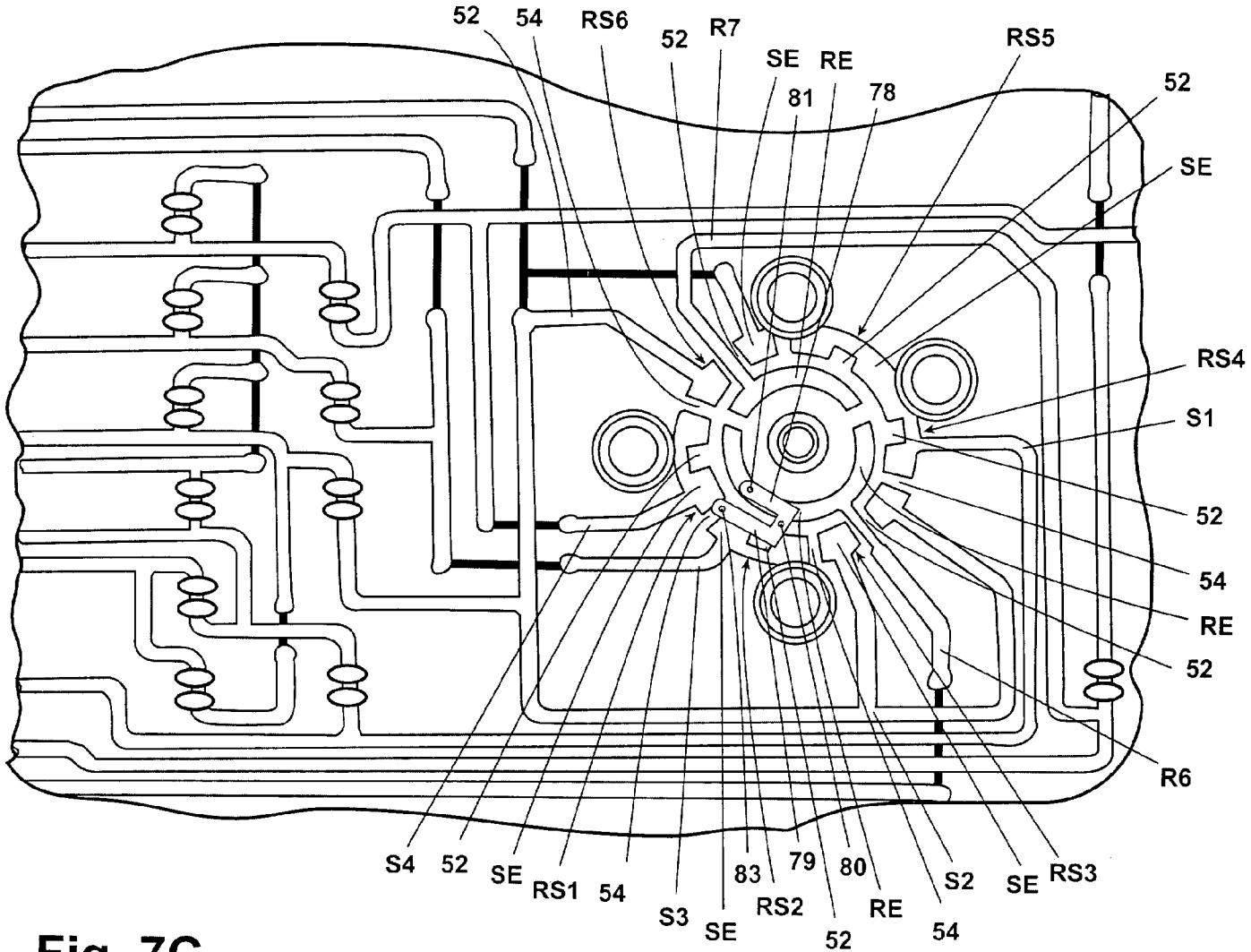
FIG. 7C is a close-up view of the circuitry shown in FIG. 6 illustrating the rotary switch in a third operable position.

As shown in FIG. 7C, as the rotary switch 26 is further rotated clockwise, the outer contact arm 79 is positioned in the inter-electrode space 54 between the position RS2 and the position RS1 so that no current flows between the receive electrode RE of either position RS2 or position RS1.

Figure 7D:
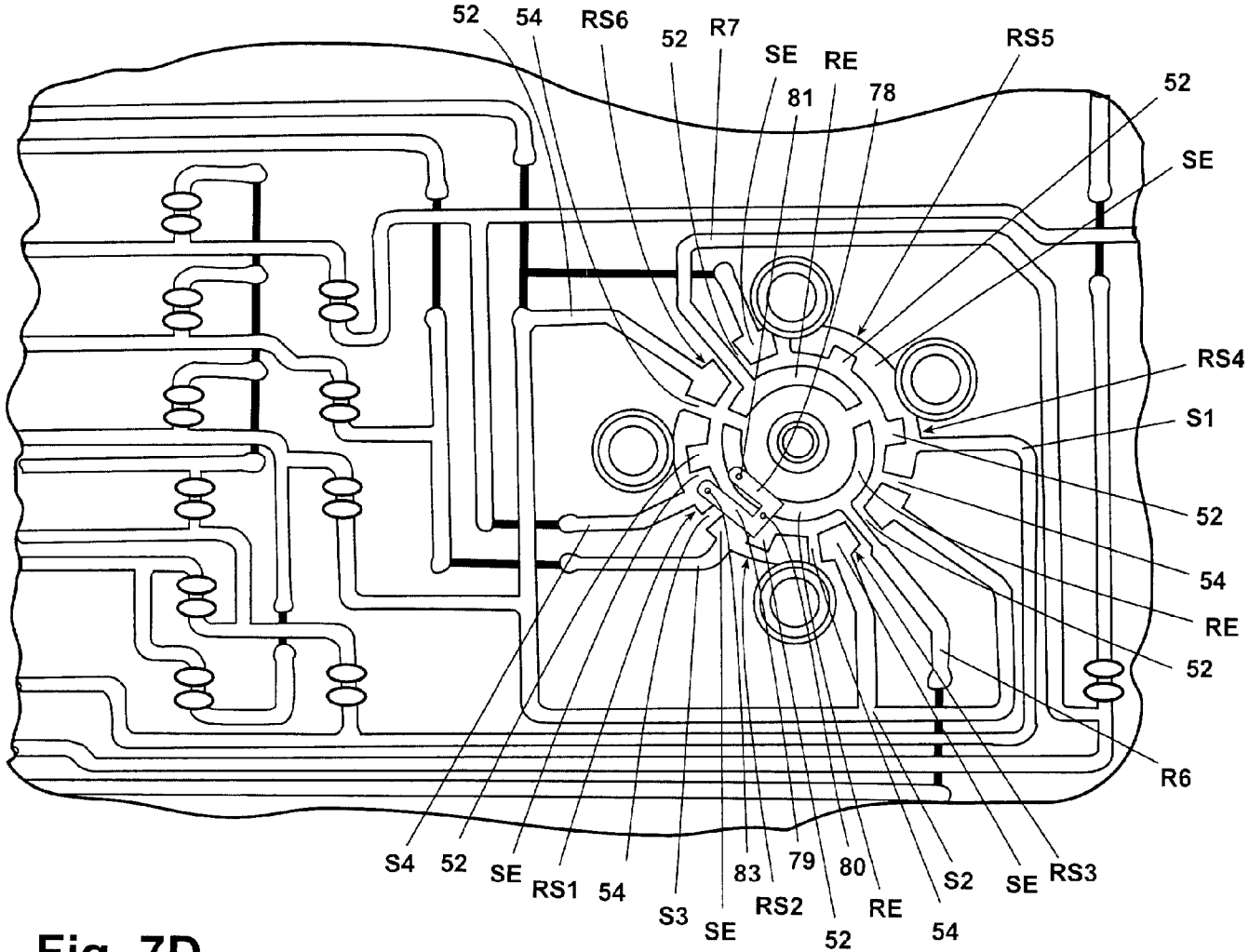
FIG. 7D is a close-up view of the circuitry shown in FIG. 6 illustrating the rotary switch in a fourth operable position.

As shown in FIG. 7D, further clockwise rotation of the rotary switch 26 will bring the outer contact arm 79 into electrical contact with the send electrode SE corresponding to position RS1, thereby enabling current to flow from the receive electrode RE, through the contact arms 78, 79 and the conductor strap 80, to the send electrode SE corresponding to position RS1.

Figure 7E:
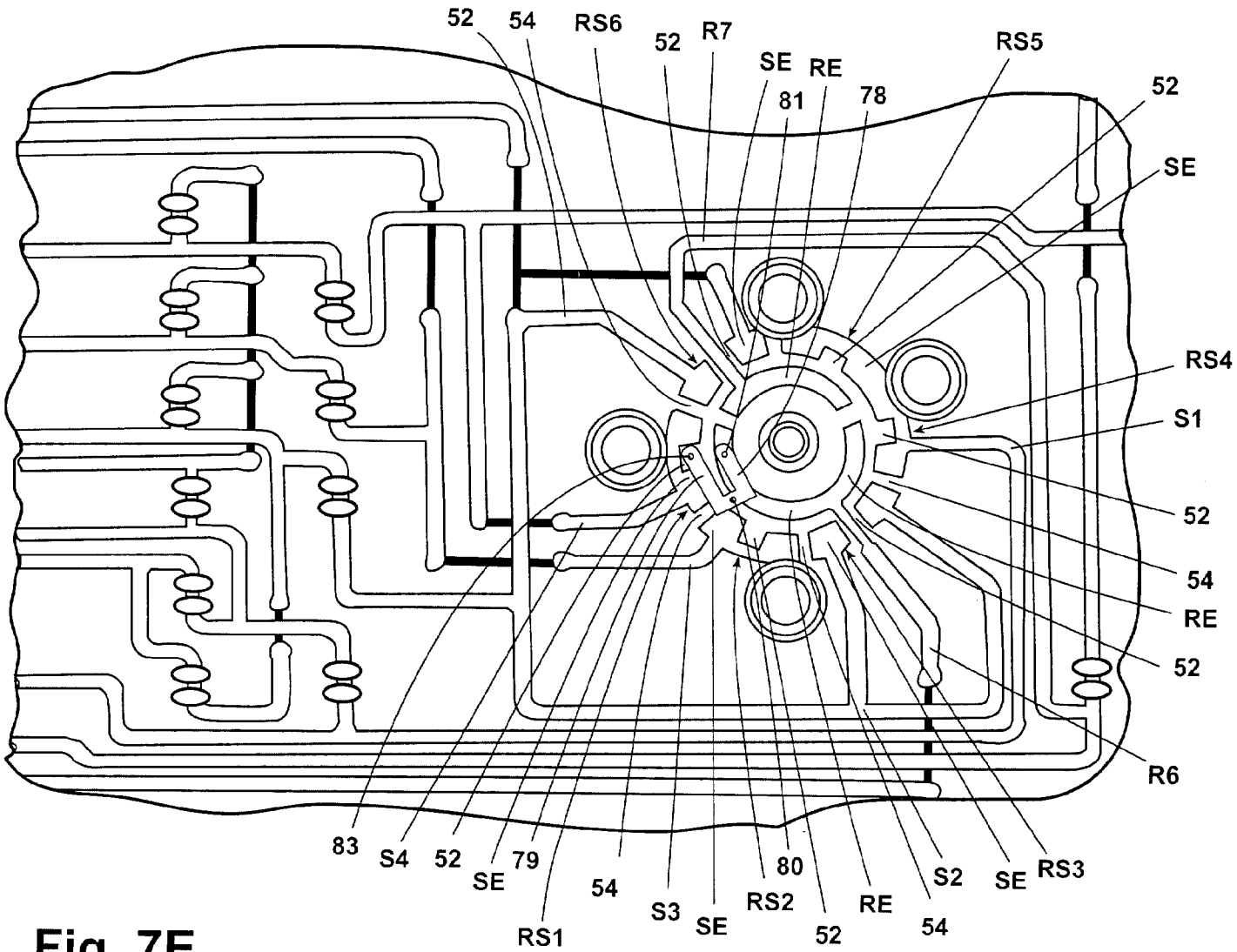
FIG. 7E is a close-up view of the circuitry shown in FIG. 6 illustrating the rotary switch in a fifth operable position.

Finally, as shown in FIG. 7E, further clockwise rotation of the rotary switch 26 will locate the outer contact arm 79 in the intra-electrode space 52 corresponding to position RS1 so that no current flows between the receive electrode RE and the send electrode SE. This position corresponds with the next detent position to provide a positive stop at this non-conductive space. Thus, rotation of the rotary switch 26 will alternately open and close an electrical circuit as the contact arms 78, 79 alternately move from an electrode space 52, 54, over an electrode RS, SE, and back to an electrode space 52, 54.

Figure 9:
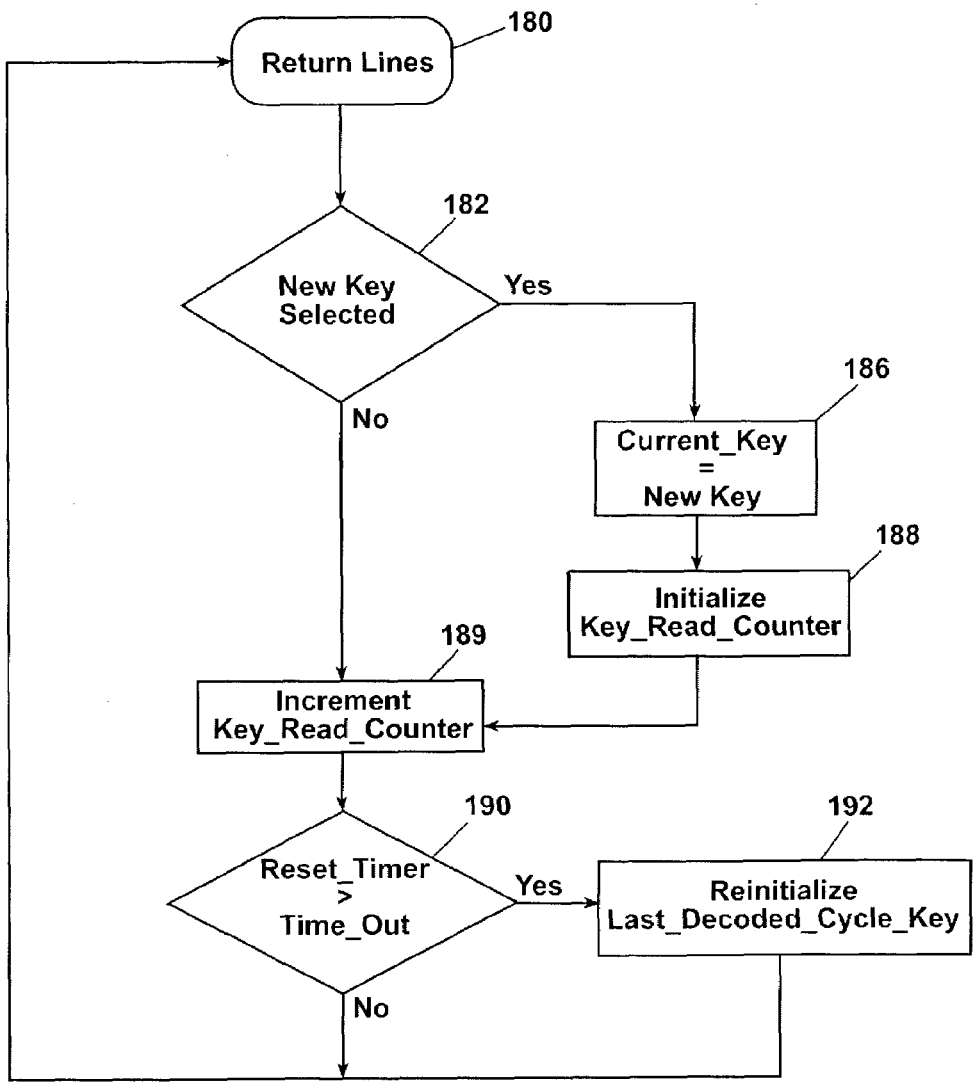
FIG. 9 is a flowchart illustrating a Key Selection Routine for determining which switch has been selected by a user.
Figure 10:
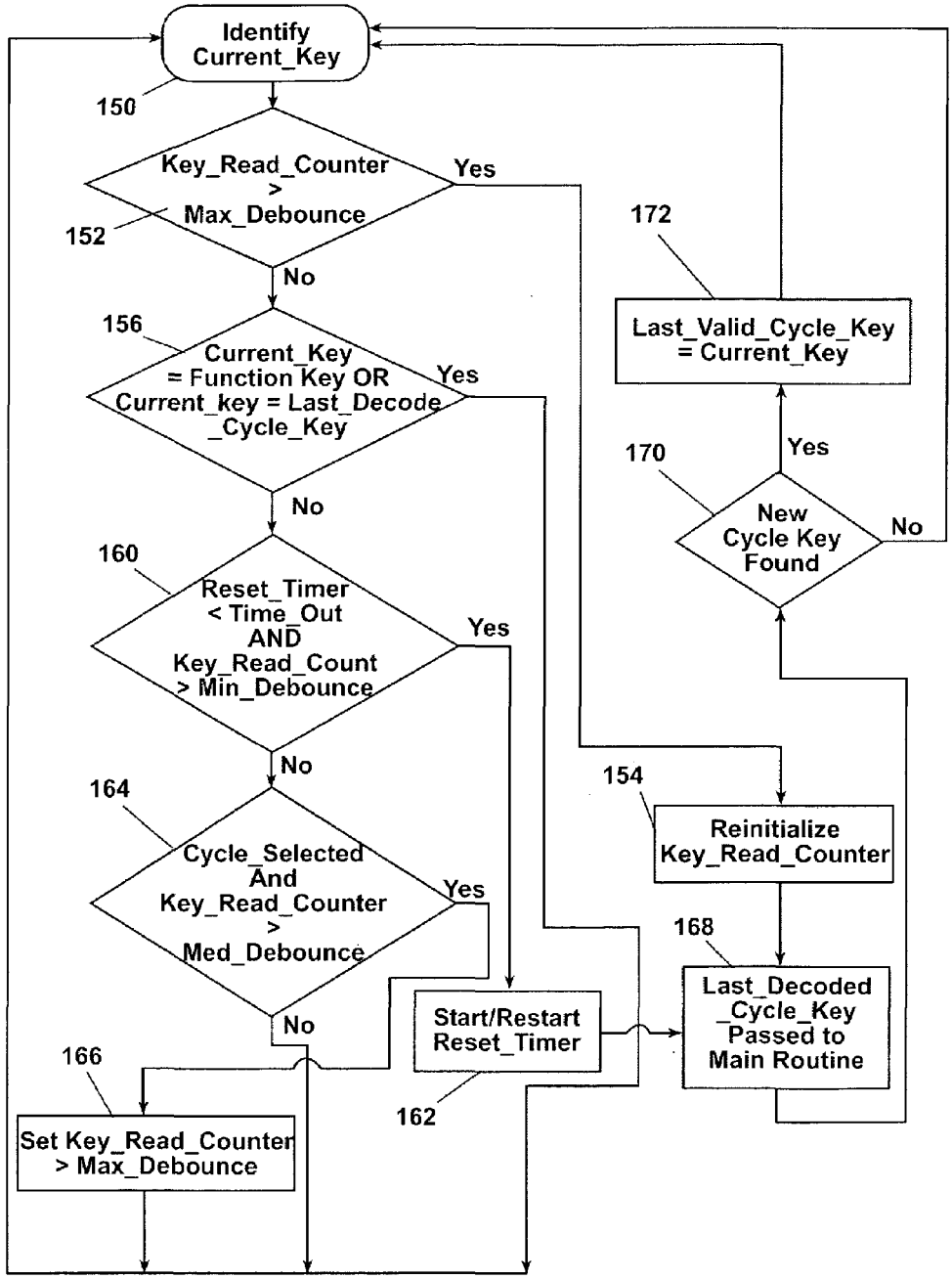
FIG. 10 is a flowchart illustrating a Cycle Verification Routine for determining if the key selected in the Key Selection Routine is a cycle key.

The operation of the controller 200 will now be described with reference to FIGS. 8–10. FIG. 8 is a schematic of the momentary pushbutton keyswitches matrix 44, the rotary switch 26, and the corresponding indicator lights, all connected to a controller 200, which is preferably a microprocessor. FIGS. 9–10 illustrate the control logic steps implemented by the controller 200 to control the operation of the appliance through the selected switches.

The schematic of FIG. 8 can be functionally divided into a switch array 202 and an illumination array 204. The switch array 202 comprises the keyswitches SW1–SW5 and the rotary switches RS1–RS6 The illumination array 204 comprises all of the indicator lights, preferably LEDs, that correspond to the switches. The illumination array is not germane to the invention and will not be described in detail. For purposes of the invention, it is only necessary to understand that the appropriate LED will be illuminated for a particular status or when a wash cycle or wash cycle option is selected.

The controller 200 comprises multiple send S1–S6 and receive R1–R8 lines that connect the switches and indicator lights to the controller 200. The switch array 202 is connected through the microprocessor by send lines S1–S6 and receive lines R6–R8. The pushbutton keyswitches SW1–SW3 are connected to receive line R8. The pushbutton keyswitches SW4–SW6 and the rotary switches RS5–RS6 are connected to receive line R7. The rotary switches RS1–RS4 are connected to receive line R6. All of the pushbutton keyswitches are connected to one of the receive lines R7 or R8, and all of the rotary switches are connected to either receive line R6 or R7. Similarly, all of the pushbutton keyswitches are connected to one of the send lines S1–S5, and all of the rotary switches are connected to one of the send lines S1–S4. Thus, all of the rotary switches lie within the sub-matrix formed by R6–R7 and S1–S4.

In the preferred embodiment, the send electrodes SE are electrically connected to a plurality of electrical leads serving the function of the send lines S1–S4 in a manner similar to an array of conventional momentary pushbutton keyswitches. Similarly, the receive electrodes RE are electrically connected to a plurality of electrical leads serving the function of the receive lines R6–R7. The send and receive lines are electrically connected to a programmable microprocessor or micro-controller 200 well-known in the art which is programmed to send a sequence of electrical pulses through the send lines S1–S6 and to monitor the receive lines R1–R8 for a returning electrical pulse in a manner similar to a matrix of momentary pushbutton keyswitches.

In a preferred detection cycle, electrical pulses are sequentially delivered by the controller 200 to each send line S1–S6, which is referred to as "strobing". Each electrical pulse that is sent to a send line is maintained for approximately 1 millisecond while the controller 200 monitors the receive lines R1–R8 to identify which receive line the pulse is traveling, indicating an ON condition for the switch corresponding to the send and receive line combination. The processor can simultaneously monitor each receive line.

Since the signal sent down each send line lasts for approximately 1 millisecond, it takes approximately 6 milliseconds to monitor all of the switches in the switch array. Consequently, a complete pulsing and monitoring cycle is completed in 6 milliseconds.

However, the preferred controller 200 is susceptible to electrical noise, which can result in a change in the voltage in the circuit and can be interpreted by the control system as a keyswitch activation. The control system must be capable of distinguishing between transient noise and a true keyswitch activation and eliminate any false positives. The preferred solution is to run multiple pulsing/monitoring cycles and obtain multiple positives indicating the same switch was selected. The number of cycles and the number and/or percentage of positives for the same switch can vary depending on the type of circuit. For the controller 200 of the invention, it is preferred that at least 8 cycles are run and that they all return a positive value for the same switch. The micro-controller is programmed with a software routine, or algorithm, to accomplish these functions.

In addition to distinguishing a selected switch from electrical noise, the control system and logic must also be able to detect the selection of both the push-button and rotary switches. The different manner in which most users activate these switches makes it difficult to use a common approach that works for both types of switches. Most users depress and hold the push-button switches for at least 20 milliseconds or until the corresponding light turns on. In contrast, the users can spin the knob of the rotary switch fast enough that the rotary switches may be ON for less than the 6 milliseconds it takes to complete a pulse cycle. Thus, traditional control logic used for push-button switches may not be able to "see" the selection of one of the rotary switches since they are looking for a longer signal pulse. The control logic of the invention can accommodate both push-button and rotary switches.

The preferred control logic is described with respect to FIGS. 9–10. It should be noted that the description of the preferred control logic is limited to the detection of the valid selection of a cycle key. The description does not include a detailed description of how the controller then controls the operation of the appliance based on a selected cycle as this is carried out in a traditional manner, which includes the actuation of the lights in the illumination array.

The control logic used to detect the selection of a cycle is based on several facts or assumptions related to the users typical operation of and the structure of the rotary and momentary switches. The control logic must be able to determine if a cycle key or a function key is selected by the user. In the control panel of the invention, the cycle keys all relate to the rotary knob and the function key are push buttons. The following description will focus on the control logic used to distinguish the user's selection of a cycle key (rotary knob) from the function keys (pushbuttons). The control logic used to detect the push buttons is otherwise conventional.

From a general overview perspective, the control logic begins with the constant polling of the switch array 202 and illumination array 204 sequentially strobing the send lines S1–S6 while monitoring the receive lines R1–R8. The most recently read key, which can be either a cycle or function key, is saved in a variable, which for purposes of this description is called the "Current_Key". Various logical tests are applied to the Current_Key value to determine if the "Current_Key" is a valid key selection. That is, the Current_Key value is not attributable to electrical noise or is a temporal selection caused by the user rotating the knob to the final selection. The last decoded or confirmed selected cycle key is saved in a variable, which for purposes of this description is called the $\text{Last_Valid}_{13}$ Cycle_Key. If the Current_Key is valid and different from the Last_Valid_Cycle_Key, the Last_Valid_Cycle_Key is updated and sent to the controller for processing the change in the selected cycle.

FIG. 9 is a flow chart of the Key Selection Routine used to determine if a key, cycle or function on the control panel 22 has been selected by the user. The Key Selection Routine is preferably completed within the same time period as the strobe rate to ensure that a selected key is found. Since the preferred strobe rate is 1 millisecond, the entire Key Selection Routine is preferably executed once for every 1 millisecond. Beginning at step 180, the controller reads the return lines R6–R8 associated with the switch array 202.

At step 182, the controller 200 determines if a new key has been selected based on the read return line value and the corresponding send line value. The read return line value is set according to the return line on which the strobe signal is read. If no key is selected, then no switch will be closed and no signal will be read on the receive lines. The controller 200 will assign a corresponding read return line value. Since the controller 200 sequentially strobes the send lines, the controller 200 will know already which send line was being polled. The combination of the send line being strobed and the read return line value function as coordinates to identify the selected key or no selected key as the case may be. These values are then compared with the values of the previously read key to determine if a new key is selected.

If a new key is selected, the controller assigns the Current_Key variable with a value corresponding to the new key. If a new key is not read, the Current_Key value is not changed. The assignment of a value to the Current_Key variable is preferably done by the controller 200 looking up the corresponding value in a data table stored in the memory of the controller.

If a new key is selected at step 182, control passes down the YES branch where the Current_Key variable is assigned its new value at step 186 and a Key_Read_Counter is initialized. The Key_Read_Counter counts the number of times that the Key Selection Routine is processed before a new key is found.

Control then passes to step 189, where the Key_Read_Counter is incremented. If a new key is not read, then control also passes to step 189 where the Key_Read_Counter is incremented.

After the Key_Read_Counter is incremented in step 189, control passes to a timer check where a Reset_Timer is tested to see if a predetermined or Time_Out_Value has been exceeded. The purpose of the Time_Out_Value is more fully described below. For now; it is sufficient to know that the Time_Out_Value is selected as the time in which if no new cycle key has been selected, then it is assumed that the Last_Valid_Cycle_Key is no longer effective and the Last_Valid_Cycle_Key is reinitialized in step 192. In the implementation described herein, the Time_Out_Value is approximately 1 second.

After the reinitialization in step 192, control is then returned to step 180 where the return lines are read once again. Similarly, if the Time_Out_Value is not exceeded, control will pass back to step 180 for another reading of the return lines. It should be obvious that on this subsequent read of the return lines, the controller 200 preferably strobes the next send line, assuming the Key Selection Routine is executed once every millisecond.

The Current_Key value from the Key Selection Routine is passed to a Cycle Verification Routine, which is illustrated in FIG. 10. The Cycle Verification Routine determines if the Current_Key is: a cycle key, different from the Last_Valid Cycle_Key, and the validity of the cycle key. If these are all true, the Last_Valid_Cycle_Key is set equal to Current_Key.

The Cycle Key Verification Routine begins at step 150 by identifying the Current_Key, which is performed by the Key Selection Routine and passing the value of the Current_Key to the Cycle_Key Verification Routine at step 150. At step 152, the Key_Read_Counter is compared to a predetermined value, which for purposes of this description is called Max_Debounce. The value of Max_Debounce represents the number of times that the same Current_Key value will be tested. Typically, the Max_Debounce value will be a multiple of the number of times the Key Selection Routine is executed.

For example, for the invention, it is desirable to obtain multiple positive validity results for the Current_Key. Since the controller strobes each send line once every millisecond, it takes 6 milliseconds to strobe or check every possible switch that could have been selected. However, one positive determination of a cycle key for the Current_Key may be attributable to electrical noise and not be a valid selection by the user. So, it is desirable to run multiple passes or cycles of the strobing of send lines S1–S6 and obtain multiple positive determinations that the Current_Key is a cycle key and that the same cycle key is selected. The multiple and identical determinations of a cycle key increase the likelihood that the user selected the cycle key and the selection is valid. For purposes of the invention, it has been determined that the Max_Debounce is greater than 48, which provides for at least 8 complete strobing cycles.

The Max_Debounce provides an upper limit to the number of iterations of the Key Selection Routine will be executed for determining the validity of a key selection. Other validity tests are applied to the Current_Key to shorten the time needed to determine a valid cycle key selection.

If the Key_Read_Counter is greater than the Max_Debounce, it is an indication that the Last_Valid_Cycle_Key has not changed within the Max_Debounce time and is still the valid cycle key. Under these conditions, control passes to step 154 where the Key_Read_Counter is reinitialized. The Last_Valid_Cycle_Key is then passed to the controller 200 at step 168 for processing in the conventional manner.

Once the Last_Valid_Cycle_Key is passed to the controller, control passes to step 170 where a test is performed to determine if a new cycle key was found. If true, control passes down the YES branch to step 172 where the Last_Valid_Cycle_Key is set to the Current_Key, and control then passes back to the beginning of the Kay Validation Routine at step 150. If false, control passes down the NO branch directly to beginning step 150, without changing the Last_Valid_Cycle_Key.

If the Key_Read_Counter does not exceed the Max_Debounce, then control passes to a second test at step 156. The second test determines if a new cycle key has been selected by checking if the Current_Key is a function key or if the Current_Key equals the Last_Valid_Cycle_Key. If either of these tests are true, it is indicative that a new cycle key has not been selected by the user and control passes down the YES branch and returns to the beginning step 150 and the validity tests are applied to the new Current_Key value. If the user is not selecting a cycle key, then the Key Validation Routine will keep looping through steps 150 and 152 until the Key_Read_Counter is greater than the Max_Debounce and reset the system.

If a new cycle key is selected, then control will pass down the NO branch to step 160, which tests to see if the user is rapidly rotating the knob at a speed that cannot be detected by the strobing cycle. To determine if there is rapid rotation of the knob, the tests of step 160 rely on the known condition of step 156 that a new cycle key has been selected, which indicates an apparent change in the cycle by the user. The tests at step 160 have two conditions that must be met. The first condition looks to see if the Reset_Timer has not exceeded the Time_Out value. The second condition looks to see if the Key_Read_Counter has exceeded a minimum count, Min_Debounce.

The Reset_Timer is used to track the time that has elapsed since a new cycle key other than the Last_Valid_Cycle_Key was selected by the user. If more than the Rest_Time has passed, it is presumed that the user rotated the knob too quickly to be trapped and the logic must be reset.

The second condition tests to make sure that at least all of the rotary switches have been strobed at least once. In the case of the invention, the rotary switches are all on send lines S1–S4. So, all of the rotary switches will be strobed within the first four counts. So, the Min_Debounce of the preferred embodiment is 3, which ensures that the Key Selection Routine has strobed all of the rotary switches at least once, even if the Reset_Timer has timed out.

If both conditions of step 160 are met (the Reset_Timer has not timed out and all of the rotary switches have been strobed at least once), then it is assumed that the Current_Key contains a new and valid cycle key. Control then passes down the YES branch to step 162 where the Reset_Timer is restarted. Control is then passed to steps 168, 170, and 172 as previously described.

While the control algorithm does not expressly track the rotational speed of the knob, the check of multiple conditions of a new key being selected at step 156 in combination with the system still in programming mode, e.g. the Reset_Timer not being timed out, and the controller has polled the switch matrix at least a minimum number of times to ensure the key selection is valid, e.g. the Key_Read_Count being greater than the Min_Debounce, provides sufficient data to make the decision that the selected key is valid.

Additionally, the debounce time can be used to represent the time that the contacts for a particular switch were coupled. The debounce time is an indication of the speed of rotation of the knob. However, the other tests help confirm that the signal read by the controller is attributable to the selection of a switch and not an error signal.

If one of the two conditions in step 160 is not met (the Reset_Timer has timed out or the Min_Debounce has not been reached), control will pass down the NO branch to the final test at step 164, which effectively tests to see if the user is slowly rotating the knob. Since the Min_Debounce value is only relevant to step 160, for all practical purposes, step 164 will be reached when the Reset_Timer has exceeded the Time_Out value and a new cycle key has been selected. For the invention, when step 164 is reached, it indicates that the user has not rotated the knob in more than a second and a new cycle key is selected.

Under the conditions of the Reset_Timer being timed out and a new cycle key selected, step 164 first checks a flag Cycle-Selected, which is indicative of the control system still is programming mode—the dishwasher is not currently running, but is awaiting information to complete the programming. The Cycle-Selected flag is set in a portion of the control system not germane to the detection of the momentary push-button switches and the rotary switches. To understand the invention, it is only necessary to know that the Cycle-Selected flag is set. If the Cycle_Selected flag is set, the control logic then checks to make sure that at least a few strobe cycles have been completed. This is accomplished by comparing the Key_Read_Counter to a medium debounce time, Med_Debounce, which for the invention is preferably greater than 16 to ensure that the rotary switches have at least been strobed 3 times.

Under these conditions, if the Cycle_Selected flag is set and the Key_Read_Count exceeds the Med_Debounce time, then it is presumed that the user has stopped rotating the knob and the new cycle key is valid. Thus, control will pass down the YES branch to step 166 where the Key_Read_Count is set greater than the Max_Debounce value, ensuring that on the next pass through the Key Validation Routine, the Last_Valid_Cycle_Key will be set to the Current_Key, which will have the value of the new cycle key, by following steps 150, 152, 154, 168, 170, and 172 as previously described.

If either of the conditions in step 164 are not satisfied, then control passes down the NO branch and returns to step 150 for continued application of the control logic.

Figure 11:
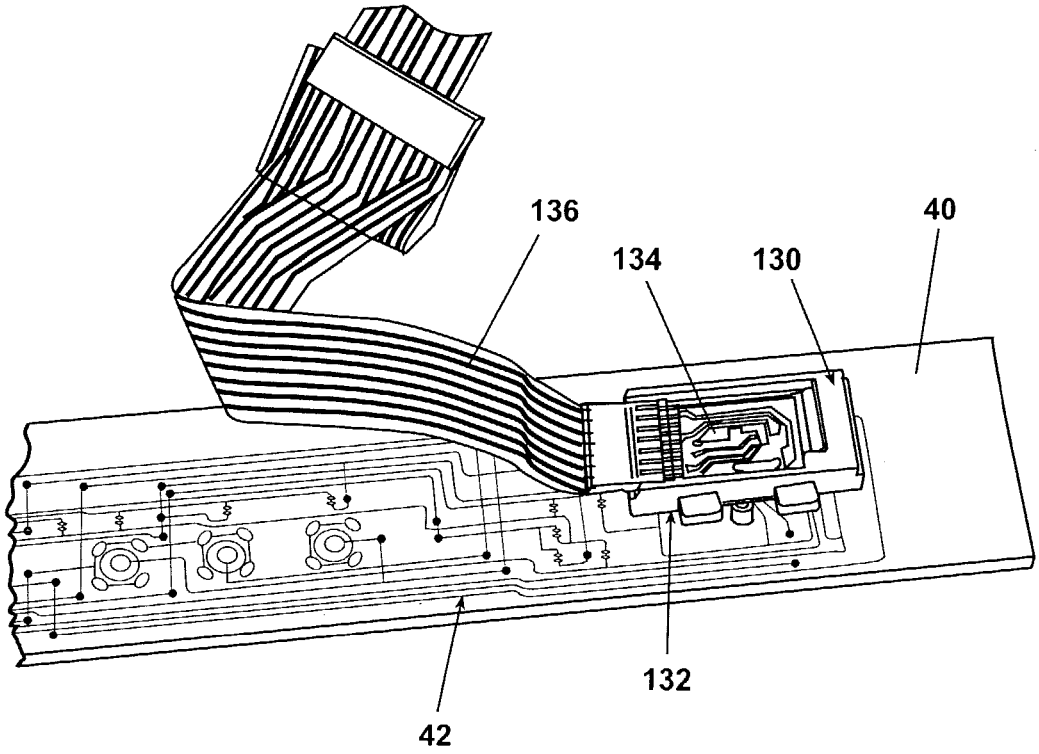
FIG. 11 is a perspective view of a second embodiment of the rotary switch shown in FIG. 1 in which the rotary switch is removeably mounted to the circuit board.

FIG. 11 shows a second embodiment comprising a modular rotary switch 130 comprising a rotor assembly 132 and a rotary switch circuit board 134 to which the rotor assembly 132 is permanently attached to form an integral part of the modular rotary switch 130. A separate rotary switch electrode matrix need not be provided on the circuit board 40. The modular rotary switch 130 operates in a manner similar to the above-described rotary switch 26 mounted to a circuit board 40 having a rotary switch electrode matrix 42, and is operably connected to the circuit board 40 through a ribbon connector 136. This second embodiment enables a rotary switch to be more readily incorporated into a control panel 22 which has been fabricated for momentary pushbutton keyswitches without a rotary switch electrode matrix 42, and enables the modular rotary switch 130 to be readily replaced into the control panel 22.

The novel rotary switch 26 and the routines described herein enable a rotary switch to be substituted into an appliance user interface for a matrix of momentary pushbutton keyswitches. The unique structure of the rotary switch 26 and the use of the routines enable the rotary switch 26 to be readily incorporated into a user interface without reprogramming of the controller. The routines accommodate different switch rotation speeds to provide an accurate selection of a cycle regardless of the manner in which the rotary switch 26 is rotated.

The novel rotary switch described herein enables a rotary switch to be used in an electronic control user interface application where momentary pushbutton keyswitches are typically used. The rotary switch described herein enables the signals from the rotary switch to be interpreted like the momentary keyswitches in a typical matrix of send and receive lines, and enables the rotary switch to serve as a "drop-in" replacement or alternative for momentary pushbutton keyswitches for cost advantages and product differentiation purposes. The novel rotary switch is easier to integrate with a currently utilized active overlay utilizing momentary pushbutton keyswitches. The inner contact balls and outer contact balls momentarily pass over electrode contacts on each side of the intra-electrode space as the switch is turned into or out of each resting position. This effectively simulates a momentary pushbutton keyswitch signal as the rotary switch is rotated. By having contacts for a given electrode on each side of the corresponding intra-electrode, the rotary switch can be turned in either a clockwise or a counterclockwise direction and still produce the desired signal. By having no electrical conductivity at the intra-electrode space, the "momentary" contact effect is achieved.

The novel rotary switch 26 is preferably incorporated into an array of pushbutton keyswitches, and is intended preferably to select from among several wash cycles, such as antibacterial, pots & pans, normal, china, quick wash, and rinse only. The pushbutton keyswitches are used to select start and cancel functions, power saver functions such as a no-heat dry cycle, or a sanitary rinse cycle.

Figure 12:
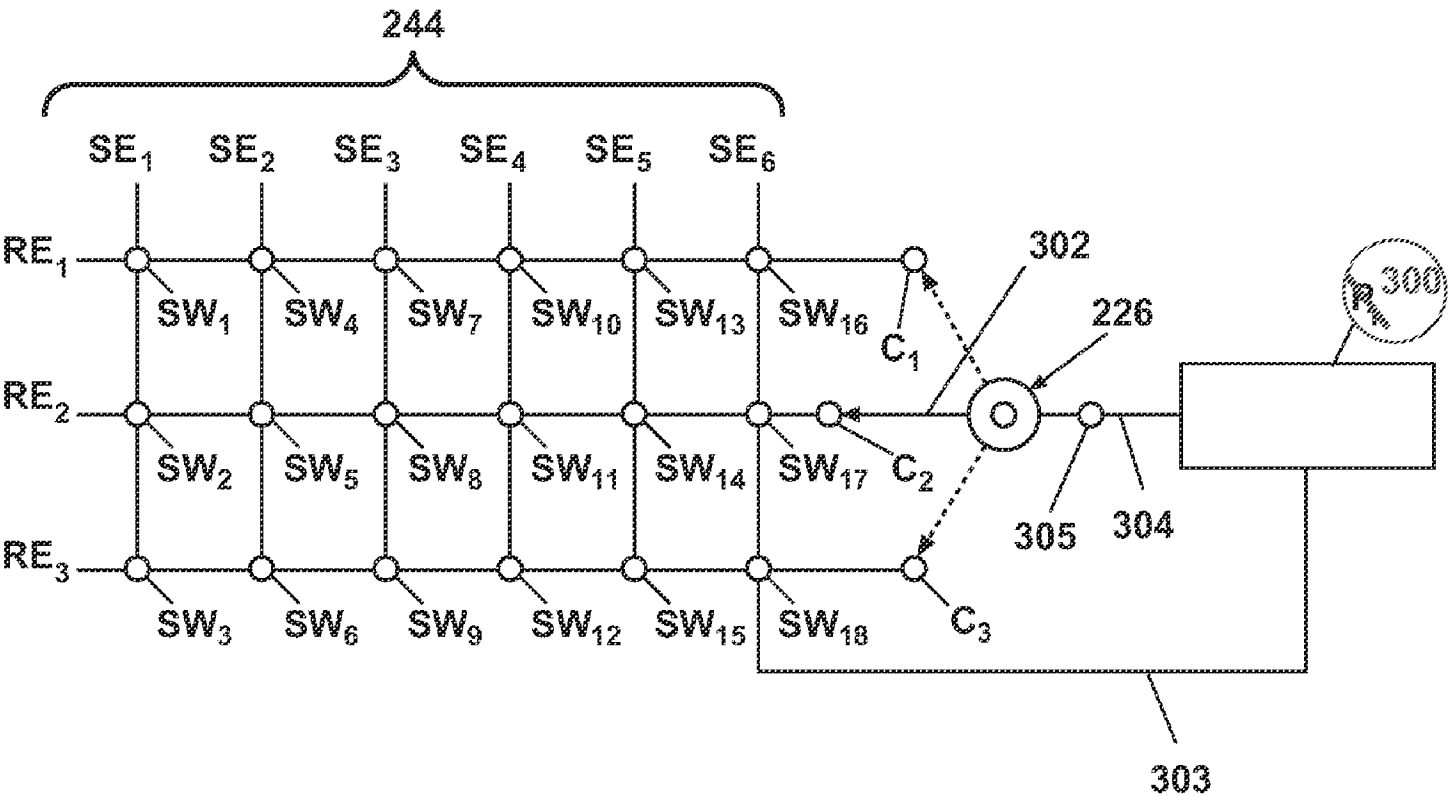
FIG. 12 is a schematic illustration of an third embodiment rotary switch in combination with a pushbutton switch matrix, with the rotary switch being closed in the detent position and using a pulse circuit to send a pulse signal down the receive line.

FIG. 12 illustrates a third embodiment of a rotary switch 226 that is usable with a momentary push-button switch matrix 244. The third embodiment rotary switch 226 differs from the previously described rotary switches in that the rotary switch 226 permits the transmission of a discreet signal, similar to that of a momentary pushbutton, when the rotary switch 226 is in the detent position.

The momentary push-button switch matrix 244 is similar to that previously described and comprises multiple send electrodes (SE1, SE2 . . . SE6) and receive electrodes (RE1, RE2 . . . RE3) to form the switch matrix. Momentary pushbutton switches SW1–SW18 are located at the intersection of send electrodes SE1–SE6 and receive electrodes RE1–RE3. The receive electrodes RE1–RE3 all terminate in a contact C1–C3. The momentary switches SW16–SW18 are optional, but preferred. If the momentary switches SW16–SW18 are not used, the send electrode SE6 will jump the receive electrodes RE1–RE3.

The rotary switch 226 can be any traditional rotary switch having a first contact, represented by arrow 302, that is selectively electrically coupled to each of the contacts C1–C3 of the receive lines by rotating the rotary switch. Preferably, the rotary switch has detent positions that correspond to the positions where the first contact 302 is connected to the contacts C1–C3 to electrically couples to the corresponding receive electrode. Such a rotary switch is traditional and well known in the art.

A pulser 300 is provided to electrically couple the rotary switch 226 to the send line SE6 such that the traditional rotary switch 226 will essentially emulate the operation of the momentary pushbutton switches. In other words, the pulser 300 permits the traditional rotary switch 226 to be closed when in a detent position, yet still provide a discrete signal similar to that of a pushbutton switch when the send electrode SE6 is polled by the microprocessor.

The pulser 300 has an input that is connected by lead line 303 to the send line SE6 and an output that is connected to an input contact 305 of the rotary switch 226 by lead line 304. With this configuration, absent the depression of any of the momentary pushbuttons SW16–SW18, when a signal is sent down the send electrode SE6, it will be carried directly to the pulser 300.

The pulser 300 can be any type of device that can convert the electrical signal sent down the send lines SE1–SE6, during polling or strobing by the microprocessor, into a discrete signal, preferably a discrete signal having the same magnitude and duration as that sent by the momentary push buttons. A suitable device for the pulser 300 is a monostable multivibrator, which is operable between a set state and a reset state. An input trigger signal, such as the signal used during polling, switches the monostable multivibrator to the set state. The monostable multivibrator automatically switches to the reset state and in doing so generates an output signal. The magnitude and duration of the output signal can be controlled by the design of the monostable multivibrator. Devices or circuits other than a monostable multivibrator can be used.

In general, the operation of the third embodiment is similar to the other embodiments in that the user will rotate the knob of the rotary switch 226 to electrically couple the contact 302 with the receive line RE1–RE3 corresponding to the selected function. The operation of the third embodiment differs in that, as the send lines SE1–SE6 are sequentially strobed, the strobing of send lines S1–S5 corresponding to the momentary pushbutton switches is accomplished in the traditional manner. If one of the pushbuttons is depressed, an electrical signal will be sent from the send line SE1–SE6 corresponding to the depressed switch to the receive line RE1–RE3 corresponding to the depressed switch, so long as the rotary switch 226 has been set to electrically couple the send lines SE1–SE6 to the receive line RE1–RE3 corresponding to the depressed switch. For example, if the rotary switch 226 is set so that the rotary switch contact 302 is connected to the contact C1, depressing any of the switches SW1, SW4, SW7, SW10, SW13, or SW16 will send an electrical signal to the receive electrode RE1.

As illustrated, the momentary push-button switch matrix 244 comprises six send electrodes and three receive electrodes, which can accommodate 18 momentary pushbutton switches. It should be understood that the number of send and receive electrodes can be selected as needed for the particular application. It should also be understood that other elements, such as lights, instead of the switches can be located at the intersection of the send and receive electrodes. Additionally, it is not necessary to have an element at each intersection. In such a case, the send electrode jumps over the corresponding receive electrode. With such a configuration, the momentary push-button switch matrix 244 as illustrated could be used in place of the switch array 202 illustrated in FIG. 8.

As illustrated, send electrodes S1–S5 are used for the momentary pushbuttons. Thus, switches SW1–SW15 correspond to momentary pushbutton switches. Send line S6 is used for the various positions of the rotary switch 226. Thus the number of send electrodes and receive electrodes can be varied as necessary to obtain the desired mix of rotary switch positions and momentary pushbutton positions. For example, as illustrated 3 of the 18 positions are for the rotary switch. If more rotary switch positions are desired, the number of receive electrodes can be increased.

Figure 13:
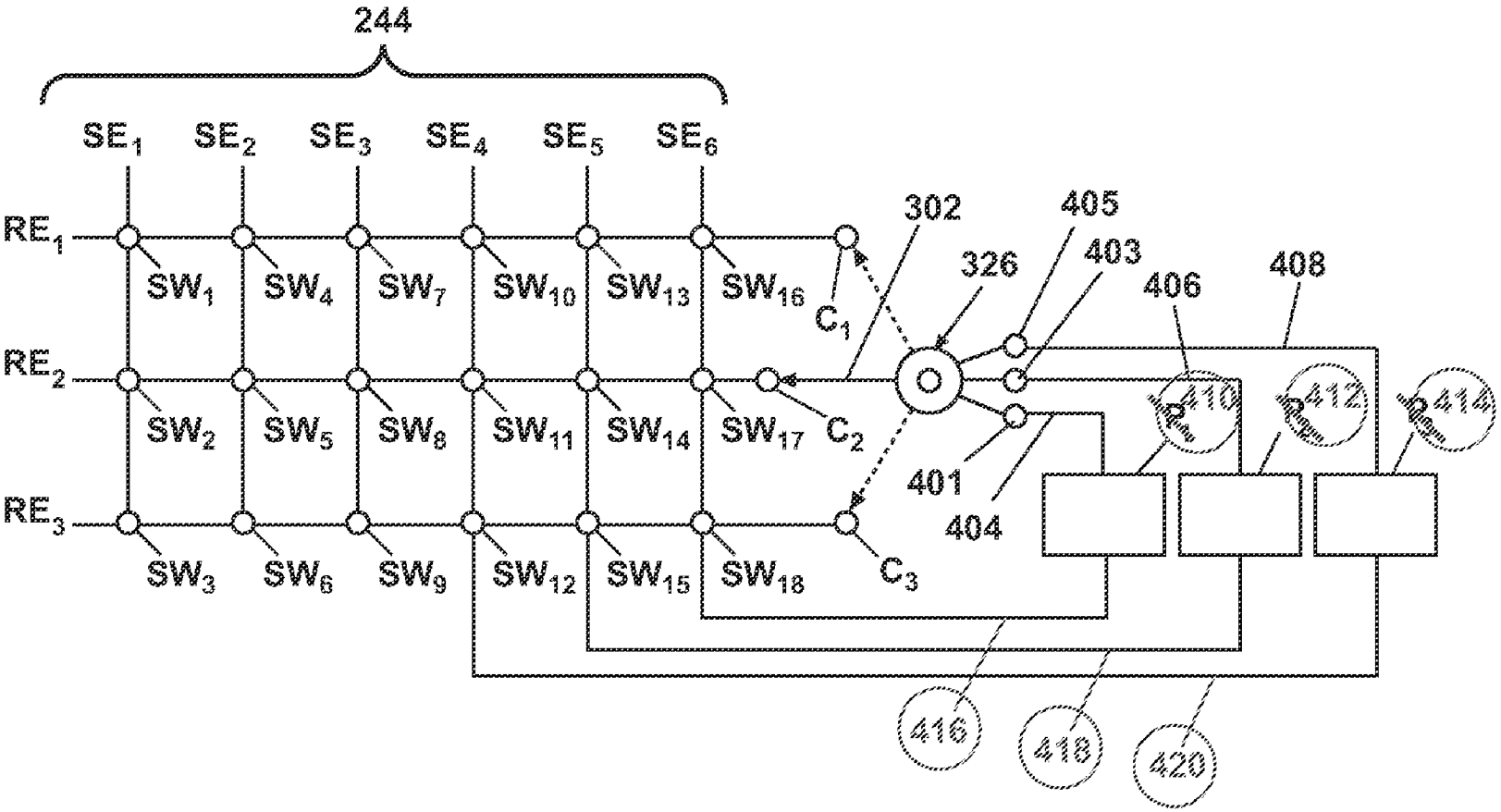
FIG. 13 is a schematic illustration of an alternative configuration for the third embodiment that uses multiple pulse circuits to send a unique signal down each of the receive lines.

FIG. 13 illustrates a variation of the third embodiment comprising a rotary switch 326 that is usable with the momentary push-button switch matrix 244. The embodiment illustrated in FIG. 13 is identical to the embodiment illustrated in FIG. 12 except that the single pulser 300 is replaced by a plurality of pulsers 410, 412, 414, illustrated in FIG. 13 as numbering 3. The rotary switch 326 also differs from the previously described rotary switch 226 in that the rotary switch 326 comprises input contacts 401, 403, 405 that are connected to the pulsers 410, 412, 414, respectively, by the lead lines 404, 406, 408, respectively. The pulsers 410, 412, 414, are also connected by individual lead lines 416, 418, 420, respectively, to the send lines SE6, SE5, SE4, respectively, rather than to the single send line SE6 only. A plurality of pulsers is used to send a unique signal down each of the receive lines RE1–RE3.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for determining which switch is selected by a user of a control panel comprising an array of momentary pushbutton switches, each operable between an open condition and a closed condition, a rotary switch having multiple normally-open, rotary momentary switches, each operable between an open condition and a closed condition, and a processor electrically coupled to all the switches, the method comprising the steps of:

determining the open/closed condition of the pushbutton and rotary momentary switches by polling the pushbutton and rotary momentary switches with the processor; and determining a user-selected switch from one of the pushbutton or rotary momentary switches based on the polled open/closed condition.

2. The method of claim 1 wherein the determination of the open/closed condition comprises strobing the open/closed condition of the pushbutton and rotary momentary switches by the processor.

3. The method of claim 1 wherein the polling is repeated for a predetermined time.

4. The method of claim 3 wherein the predetermined time is great enough to permit multiple pollings of each of the pushbutton and rotary momentary switches.

5. The method of claim 4 wherein the predetermined time is great enough to permit up to eight pollings of each of the pushbutton and rotary momentary switches.

6. The method of claim 3 and further comprising determining when the user-selected switch is one of the rotary momentary switches.

7. The method of claim 6 and further comprising determining if the user-selected switch is indicative of a new selection by the user.

8. The method of claim 7 wherein the determination of a new selection of a user-selected rotary switch comprises comparing a current selection of the user-selected rotary switch to a prior selection of the user-selected rotary momentary switch and determining if the current selection is different from the prior selection.

9. The method of claim 7 and further comprising the user selecting the rotary switches by rotating a knob.

10. The method of claim 9 and further comprising the determination of a rapid-rotation condition where the user is rotating the knob at a rate faster than what can be read by the controller.

11. The method of claim 10 wherein upon the determination of the rapid-rotation condition, the determination of the user-selected rotary switch is made prior to the predetermined time.

12. The method of claim 11 wherein the determination of the user-selected rotary switch is made after a single strobing of each of the rotary switches.

13. The method of claim 9 and further comprising the determination of a slow-rotation condition where the user is rotating the knob at a rate such that the user does not select the rotary switch within the predetermined time.

14. The method of claim 13 wherein upon the determination of a slow-rotation condition, the user-selected rotary switch is determined after a time out period, which is greater than the predetermined time, and after each of the rotary switches is polled a predetermined number of times.

15. The method of claim 14 wherein each of the rotary switches is polled at least three times.

16. The method according to claim 1 wherein the determining of the user-selected switch is accomplished without user confirmation.

17. A method for determining which switch is selected by a user of a control panel comprising an array of momentary pushbutton switches, each operable between an open condition and a closed condition, a rotary switch having multiple normally-open, rotary momentary switches, each operable between an open condition and a closed condition, with a rotatable knob for selecting one of the rotary momentary switches, and a processor electrically coupled to all the switches, the method comprising the steps of:

determining when the user-selected switch is one of the rotary momentary switches; and determining a rapid-rotation condition where the user is rotating the knob at a rate faster than what can be read by the controller.

18. The method according to claim 17 and determining the open/closed condition of the rotary momentary switches by polling the rotary momentary switches with the processor.

19. A method for determining which switch is selected by a user of a control panel comprising an array of momentary pushbutton switches, each operable between an open condition and a closed condition, a rotary switch having multiple normally-open, rotary momentary switches, each operable between an open condition and a closed condition, with a rotatable knob for selecting one of the rotary momentary switches, and a processor electrically coupled to all the switches, the method comprising the steps of:

determining when the user-selected switch is one of the rotary momentary switches; and determining a slow-rotation condition where the user is rotating the knob at a rate such that the user does not select the rotary switch within a predetermined time.

20. The method according to claim 19 and determining the open/closed condition of the rotary momentary switches by polling the rotary momentary switches with the processor.

* * * * *